US008698714B2

(12) United States Patent
Ozawa et al.

(10) Patent No.: US 8,698,714 B2
(45) **Date of Patent: *Apr. 15, 2014**

(54) ELECTRONIC CIRCUIT, METHOD OF DRIVING ELECTRONIC CIRCUIT, ELECTRO-OPTICAL DEVICE, AND ELECTRONIC APPARATUS

(75) Inventors: Tokuro Ozawa, Suwa (JP); Toshiyuki Kasai, Okaya (JP); Eiji Kanda, Suwa (JP); Ryoichi Nozawa, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 298 days.

This patent is subject to a terminal disclaimer.

(21) Appl. No.: 12/630,873

(22) Filed: Dec. 4, 2009

(65) Prior Publication Data

US 2010/0079357 A1 Apr. 1, 2010

Related U.S. Application Data

(63) Continuation of application No. 11/092,580, filed on Mar. 29, 2005, now Pat. No. 7,649,515.

(30) Foreign Application Priority Data

Apr. 22, 2004 (JP) ..... 2004-126931

(51) Int. Cl.
*G09G 3/32* (2006.01)
*G09G 3/30* (2006.01)

(52) U.S. Cl.
USPC ..... 345/82; 345/76

(58) Field of Classification Search
USPC ..... 345/76–83, 36, 44–46; 315/169.3; 313/463
See application file for complete search history.

(56) References Cited

U.S. PATENT DOCUMENTS 6,229,506 B1 5/2001 Dawson et al.
7,057,588 B2 6/2006 Asano et al.

(Continued)

FOREIGN PATENT DOCUMENTS

JO A-2003-223138 8/2003
JP A-2003-73165 3/2003

(Continued)

*Primary Examiner* — Jimmy H Nguyen
(74) *Attorney, Agent, or Firm* — Oliff PLC

(57) ABSTRACT

To reduce the time for writing a voltage onto a gate of a driving transistor. In an initialization period, a node B is fixed to an initial voltage $V_{INI}$, transistors are turned on, and a current flows into an OLED element, such that a voltage according to the current is held at the node A. Thereafter, the transistors are sequentially turned off, such that a threshold voltage of a driving transistor is held at the node A. In a writing period, a transistor is turned on and a data signal X-j is supplied, such that a voltage of the node B varies by the amount according to the current flowing into the OLED element. The voltage of the node A varies from the threshold voltage by the amount which is obtained by dividing the voltage variation by a capacitance ratio. In a light-emitting period, the transistor is turned on, such that a current according to the voltage of the node A flows into the OLED element.

6 Claims, 19 Drawing Sheets

(56) References Cited

U.S. PATENT DOCUMENTS

| | | | | |
|---|---|---|---|---|
| 7,456,810 | B2 | 11/2008 | Kimura | |
| 2002/0043991 | A1 * | 4/2002 | Nishitoba | 327/94 |
| 2003/0095087 | A1 * | 5/2003 | Libsch et al. | 345/82 |
| 2003/0122745 | A1 | 7/2003 | Miyazawa | |
| 2004/0080474 | A1 | 4/2004 | Kimura | |
| 2004/0095298 | A1 | 5/2004 | Miyazawa | |
| 2004/0252089 | A1 | 12/2004 | Ono et al. | |
| 2005/0243036 | A1 | 11/2005 | Ikeda | |

FOREIGN PATENT DOCUMENTS

| | | | |
|---|---|---|---|
| JP | A-2003-177709 | | 6/2003 |
| JP | A-2003-195809 | | 7/2003 |
| JP | A-2004-93777 | | 3/2004 |
| JP | A-2004-133240 | | 4/2004 |
| JP | A-2004-286816 | | 10/2004 |
| JP | A-2004-341359 | | 12/2004 |
| JP | A-2005-326828 | | 11/2005 |
| WO | WO 03/001496 | A1 | 1/2003 |

* cited by examiner (1a) INITIALIZATION PERIOD (1b) INITIALIZATION PERIOD (1c) INITIALIZATION PERIOD (2) WRITING PERIOD (3) LIGHT-EMITTING PERIOD

ELECTRONIC CIRCUIT, METHOD OF DRIVING ELECTRONIC CIRCUIT, ELECTRO-OPTICAL DEVICE, AND ELECTRONIC APPARATUS

This application is a continuation of U.S. patent application Ser. No. 11/092,580, filed on Mar. 29, 2005, and which claims priority to Japanese Patent Application No. 2004-126931, filed on Apr. 22, 2004. The disclosures of the prior applications are hereby incorporated by reference in their entirety

BACKGROUND

The present invention relates to an electronic circuit for driving a current-driven element, such as an organic light-emitting diode element, a method of driving the electronic circuit, an electro-optical device, and an electronic apparatus.

In recent years, as a next-generation light-emitting element that replaces liquid crystal elements, an organic light-emitting diode element (hereinafter, suitably referred to as 'OLED element') called as an organic electroluminescent element or a light-emitting polymer element has been drawing a considerable attention. The OLED element has a low viewing angle dependency because it is a self-emitting type. Further, because the backlight or reflected light is not required, the OLED element has excellent characteristics such as low power consumption and a reduced thickness as a display panel.

Here, the OLED element is a current-driven element in which the light emission state cannot be held when the current is disrupted, without having the voltage maintenance property, unlike the liquid crystal devices. For this reason, in the case of driving the OLED element in an active matrix manner, a configuration that a voltage according to the gray-scale level of the pixel is written onto the gate of a driving transistor to hold the voltage by a gate capacitance or the like in a writing period (a selection period) is used, in which the driving transistor continuously flows the current according to the gate voltage into the OLED element.

However, in this configuration, there is a problem in that the threshold voltage characteristic of the driving transistor is deviated, and thus the brightness of the OLED element varies in each pixel to consequently deteriorate the display quality. For this reason, recently, a technology has been suggested, in which the driving transistor is brought into diode connection and the constant current flows from the driving transistor into a data line, such that the voltage according to the current flowing into the OLED element is written onto the gate of the driving transistor so as to compensate the deviation of the threshold voltage characteristic of the driving transistor (for example, see Patent Documents 1 and 2).

[Patent Document 1] U.S. Pat. No. 6,229,506 (see FIG. 2)

[Patent Document 2] Japanese Unexamined Patent Publication No. 2003-177709 (see FIG. 3)

However, in this technology, in the case of using an N-channel driving transistor, when the current flowing into the OLED element is set to become small, the gate voltage of the driving transistor is low and it is difficult to flow the current between the source and the drain of the driving transistor, in the writing period. Accordingly, there is a problem in that the required voltage cannot be written onto the gate of the driving transistor in the writing period.

Accordingly, the present invention has been made in consideration of the above-mentioned problems, and it is an object of the present invention to provide an electronic circuit, in which a voltage according to a current flowing into a driven element can be quickly written onto the gate of the driving transistor, a method of driving the electronic circuit, an electro-optical device using the electronic element, and an electronic apparatus.

SUMMARY

In order to achieve the above-mentioned objects, according to the present invention, there is provided a method of driving an electronic circuit having a driving transistor for controlling a current flowing into a driven element, a first switching element provided between a gate and a drain of the driving transistor to be turned on or off, and a capacitive element one end of which is connected to the gate of the driving transistor. The method of driving an electronic circuit comprises a first step of applying an initial voltage to the other end of the capacitive element to allow the current to flow into the driven element in a case in which the first switching element is turned on, and then blocking the current to interrupt the application of the initial voltage to the other end of the capacitive element to turn off the first switching element, a second step of applying a voltage corresponding to the current flowing into the driven element to the other end of the capacitive element, and a third step of causing the driving transistor to make a current according to a held gate voltage flow into the driven element. According to this method, in the first step, when the first switching element is turned on and off, a voltage according to a threshold value of the driving transistor is held at the one end of the capacitive element and at the gate (a node A) of the driving transistor. Next, in the second step, the voltage of the other end of the capacitive element varies from the initial voltage by applying the voltage according to the current flowing into the driven element and thus the voltage of the node A varies by the amount according to the voltage variation and is held. In the third step, the current according to the voltage of the node A after varying flows into the driven element, but, from the current at this time, threshold value characteristics of the driving transistor is cancelled. In the first step, the voltage according to the current forcibly flowing into the driven element is held at the capacitive element, and thus the time is not required. Further, in the second step, the voltage according to the current flowing into the driven element is applied to the other end of the capacitive element. Thus, the voltage is not directly applied to the gate of the driving transistor, and thus the time required for writing the voltage can be reduced.

According to this driving method, in the first step, the first switching element is turned on and the current flows into the driven element such that the voltage according to the current is held at the one end of the capacitive element and at the gate of the driving transistor. Then, after the current is blocked, the first switching element is turned off such that the voltage held at the one end of the capacitive element and the gate of the driving transistor is set to the voltage according to the threshold voltage of the driving transistor. According to this method, when the first switching element is turned on, the driving transistor is brought into diode connection, and the node A has the voltage according to the current flowing into the driven element under the diode connection state. Thereafter, when the diode connection is interrupted, the voltage of the node A is set to the voltage according to the threshold voltage of the driving transistor.

Further, in the first step, the first switching element is turned on and the current flows into the driven element such that the voltage according to the current and the threshold voltage of the driving transistor may be held at the one end of the capacitive element and at the gate of the driving transistor.

According to this method, when the first switching element is turned on, the driving transistor is brought into diode connection, and the node A has the voltage according to the current flowing into the driven element under the diode connection state. For this reason, the held voltage of the node A becomes the voltage according to the current and the threshold voltage of the driving transistor.

On the other hand, in the first step, after the first switching element is turned on and the current flows into the driven element, the current is blocked and the first switching element is turned off such that the voltage according to the threshold voltage of the driving transistor is held at the one end of the capacitive element and at the gate of the driving transistor. According to this method, when the first switching element is turned on, a relatively small current can flow into the driven element, and thus the voltage according to the threshold voltage of the driving transistor can be held at the node A.

In any methods, the first step can be performed during the time longer than that of the second step before the second step of applying the voltage according to the current flowing into the driven element to the other end of the capacitive element, independently of the second step.

In order to achieve the above-mentioned objects, there is provided an electronic circuit according to the present invention. The electronic circuit comprises a driving transistor for controlling a current flowing into a driven element, a first switching element provided between a gate and a drain of the driving transistor to be turned on in a first period and to be turned off from the first period up to the beginning of a second period, a capacitive element, one end of which is connected to the gate of the driving transistor, a second switching element which is turned on to apply an initial voltage to the other end of the capacitive element in the first period and which is turned off in the second period and a subsequent third period, and a third switching element provided between a signal line to which a voltage according to the current flowing into the driven element is applied and the other end of the capacitive element to be turned on in the second period. According to this electronic circuit, the current can flow into the driven element without depending on the threshold value characteristics of the driving transistor, and the time required for writing the voltage according to the current can be reduced.

The electronic circuit may further comprise a fourth switching element, disposed in a path of the current flowing into the driven element, for blocking the current flowing into the driven element, when being turned off, regardless of a gate voltage of the driving transistor. The fourth switching element is turned on in a portion or throughout the whole first period and is turned on in the third period. According to this configuration, the time during which the current controlled by the driving transistor flows into the driven element can be adjusted by turning on or off the fourth switching element.

In a case in which the fourth switching element is used, the first and fourth switching elements may be different conductivity-type transistors and gates of the first and fourth switching elements may be connected to a common control line. Alternatively, the first and second switching elements may be the same conductivity-type transistors and gates of the first and second switching elements may be connected to a common control line. In any configurations, the number of wiring lines to the electronic circuit can be reduced.

Moreover, the latter configuration may be applied to the case in which the fourth switching element is not used. When this configuration is applied to the case that the fourth switching element is not used, the driven element and the driving transistor may be provided in a current path between first and second power supply lines, and the voltage between the first and second power supply lines may be the initial voltage in the first period and may be a predetermined power supply voltage in the third period. In this configuration, the second switching element may be provided between the other end of the capacitive element and the drain of the driving transistor to be turned on or off and the initial voltage may be applied to the other end of the capacitive element through the power supply line. In other cases, the second switching element may be provided between the other end of the capacitive element and a feed line, to which the initial voltage is applied, to be turned on or off, such that the initial voltage may be applied to the other end of the capacitive element through the feed line.

Moreover, in the above-described electronic circuit, the driven element may be an electro-optical element, and more particularly, an organic light-emitting diode element.

In order to achieve the above-mentioned objects, there is provided an electro-optical device having pixel circuits arranged to correspond to intersections of scanning lines to be sequentially selected and data lines to which a voltage according to a current flowing into an electro-optical element is applied. Each of the pixel circuits comprises a driving transistor for controlling the current flowing into the electro-optical element, a first switching element provided between a gate and a drain of the driving transistor to be turned on in a first period and to be turned off from the first period up to the beginning of a second period, and a capacitive element, one end of which is connected to the gate of the driving transistor, a second switching element which is turned on in the first period to apply an initial voltage to the other end of the capacitive element and which is turned off in the second period and a subsequent third period, and a third switching element provided between the corresponding data line and the other end of the capacitive element to be turned on in the second period. According to the electro-optical device, the current can flow into the electro-optical element without depending on the threshold value characteristic of the driving transistor, and the time required for writing the voltage according to the current can be reduced.

Further, an electronic apparatus according to the present invention may comprise the electro-optical device.

DETAILED DESCRIPTION OF EMBODIMENTS

Hereinafter, embodiments of the present invention will be described with reference to the accompanying drawings <First Embodiment>

Figure 1:
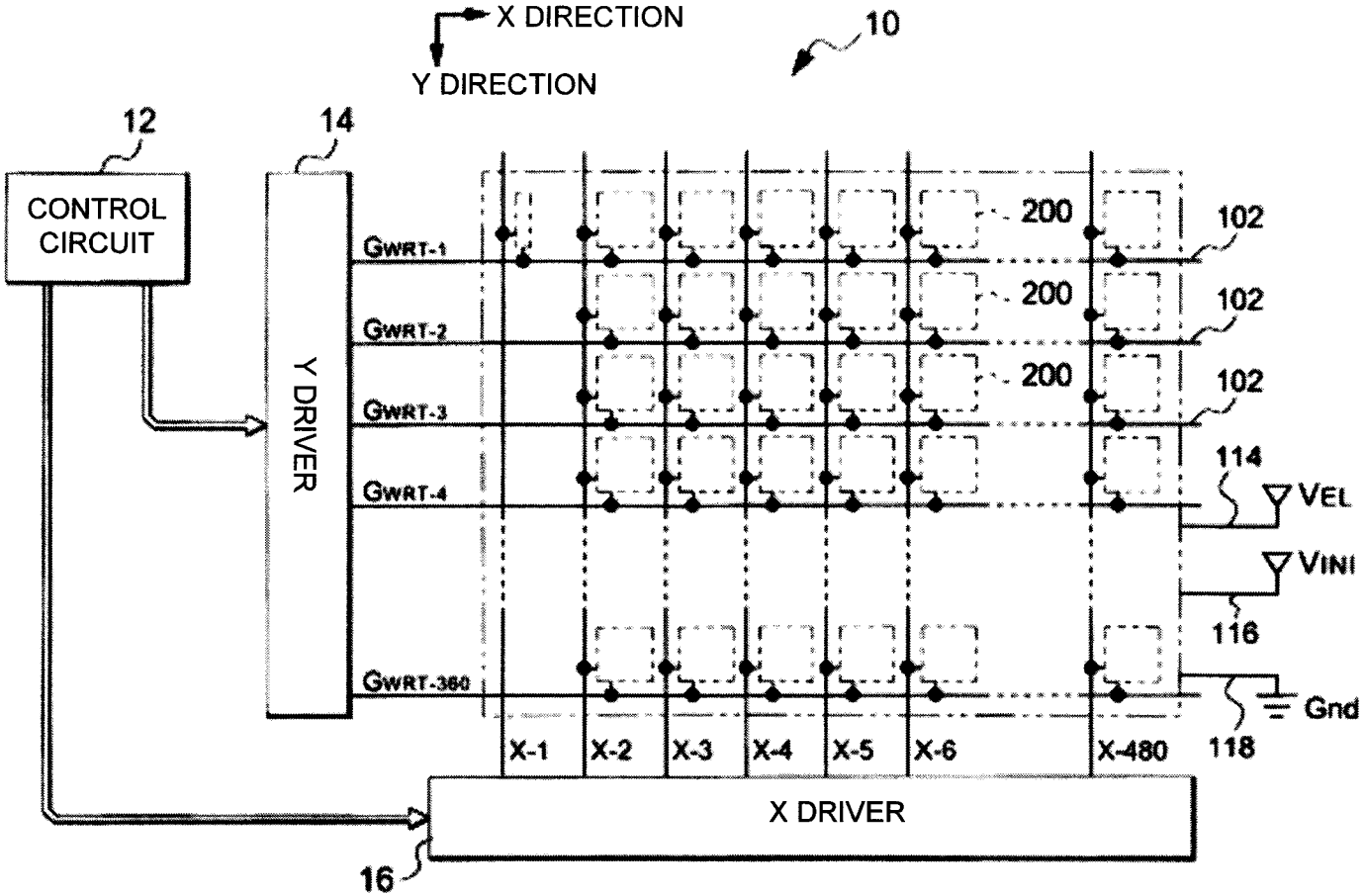
FIG. 1 is a block diagram showing a configuration of an electro-optical device according to a first embodiment of the present invention.
Figure 2:
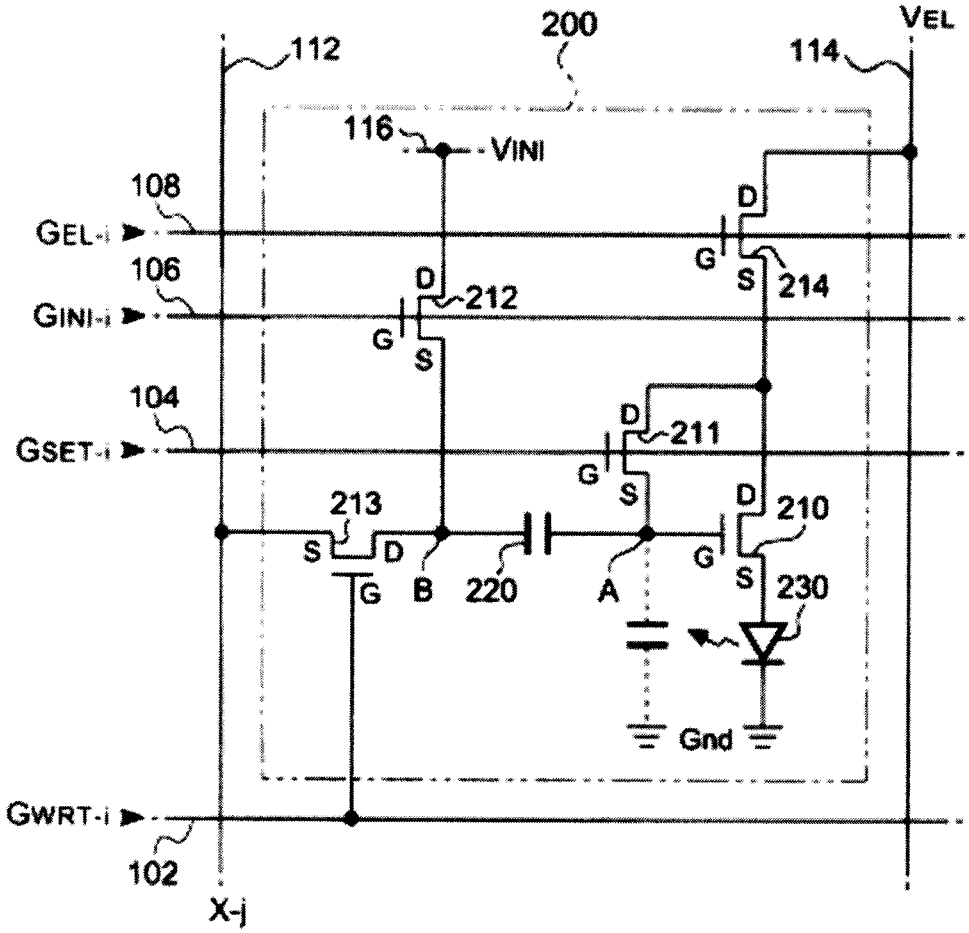
FIG. 2 is a diagram showing a pixel circuit of the electro-optical device.

FIG. 1 is a block diagram showing the configuration of an electro-optical device according to a first embodiment of the present invention. Further, FIG. 2 is a diagram showing the configuration of a pixel circuit of the electro-optical device.

First, as shown in FIG. 1, in the electro-optical device 10, a plurality of scanning lines 102 are arranged in a horizontal direction (an X direction) and a plurality of data lines (signal lines) 112 are arranged in a vertical direction (a Y direction). Further, pixel circuits (electronic circuits) 200 are respectively provided to correspond to intersections of the scanning lines 102 and the data lines 112.

For convenience of the explanation, in the present embodiment, it is assumed that the number of the scanning lines 102 (the number of rows) is 360, the number of the data lines (the number of columns) is 480, and the pixel circuits 200 are arranged in a matrix shape of vertical 360 rows×horizontal 480 columns. However, this arrangement is not intended to limit the present invention.

Moreover, each pixel circuit 200 has an OLED element described below, and a predetermined gray-scale level image is displayed by controlling a current flowing into the OLED element for each pixel circuit 200.

In addition, in FIG. 1, only the scanning lines 102 are arranged in the X direction, however, in the present embodiment, in addition to the scanning lines 102, control lines 104, 106, and 108 are arranged in the X direction for each row. Specifically, the scanning line 102 and the control lines 104, 106, and 108 are common to the pixel circuit 200 for one row.

A Y driver 14 selects the scanning line 102 by one row for each horizontal scanning period, supplies a scanning signal of H level to the selected scanning line 102, and supplies various control signals to the control lines 104, 106, and 108 in synchronization with the selection. That is, the Y driver 14 supplies the scanning signal and the control signals to the scanning line 102 or the control lines 104, 106, and 108 for each row.

Here, for convenience of the explanation, the scanning signal supplied to the scanning line 102 of an i-th row (i is an integer satisfying $1 \leq i \leq 360$ and is used to explain the rows generally) is referred to as $G_{WRT-i}$. Similarly, the control signals supplied to the control lines 104, 106, and 108 of the i-th row are referred to as $G_{SET-i}$, $G_{INI-i}$, and $G_{EL-i}$, respectively.

On the other hand, an X driver 16 supplies a data signal having a voltage according to a current (that is, a gray-scale level of a pixel) flowing into the OLED element in the pixel circuit 200 to the pixel circuits for one row corresponding to the scanning line 102 selected by the Y driver 14, that is, each of the pixel circuits 200 of the 1st to 480th columns located at the selected row, through the data lines 112 of the 1st to 480th columns. Here, the data signal is designated so that the pixel become bright as the voltage becomes high and the pixel become dark as the voltage becomes low.

Moreover, for convenience of the explanation, the data signal supplied to the data line 112 of the j-th column (j is an integer satisfying $1 \leq i \leq 480$ and is used to explain the columns generally) is referred to as X-j.

All the pixel circuits 200 are supplied with a high level voltage $V_{EL}$ serving as a power supply source of the OLED element through the power supply line 114. In addition, in the present embodiment, all the pixel circuits 200 are commonly connected to a reference voltage Gnd through the power supply line 118.

Moreover, the voltage of the data signal X-j for designating black which is the lowest gray-scale level of the pixel is set to be higher than Gnd and the voltage of the data signal X-j for designating white which is the highest gray-scale level of the pixel is set to be lower than $V_{EL}$. Specifically, the voltage range of the data signal X-j is set so as to falls within the power supply voltage.

On the other hand, in the present embodiment, the pixel circuits 200 are supplied with an initial voltage $V_{INI}$ through a feed ling 116. Here, in the present embodiment, the initial voltage $V_{INI}$ means the lowest value in the voltage range of the data signal X-j. That is, it is approximately equal to the data signal voltage for designating the lowest gray-scale level of the pixel.

The control circuit 12 supplies block signals (not shown) or the like to the Y driver 14 and the X driver 16 to control them and supplies image data for defining the gray-scale level for each pixel to the X driver 16.

In the present embodiment, all the pixel circuits 200 arranged in the matrix shape have a common configuration. Accordingly, the configuration of the pixel circuit 200 will be described with the pixel circuit located at the i-th row and the j-th column as a representative.

As shown in FIG. 2, the pixel circuit 200 has a n-channel driving transistor 210, n-channel transistors 211, 212, 213, and 214 which serve as first to fourth switching elements, a capacitor 220 which serves as a capacitive element, and an OLED element 230 which is the electro-optical device.

Among them, one end (a drain) of the transistor 214 is connected to the power supply line 114, and the other end (a source) of the transistor 214 is connected to a drain of the driving transistor 210 and one end (a drain) of the transistor 211. Here, a gate of the transistor 214 is connected to the control line 108 of the i-th row. For this reason, the transistor 214 is turned on when the control signal $G_{EL-i}$ is H level and is turned off when the control signal is L level.

A source of the driving transistor 210 is connected to an anode of the OLED element 230 and a cathode of the OLED element 230 is grounded to the low level voltage Gnd of the power supply. For this reason, the OLED element 230 is electrically disposed in a path between the high level voltage $V_{EL}$ and the low level voltage Gnd, together with the driving transistor 210 and the transistor 214.

A gate of the driving transistor 210 is connected to one end of the capacitor 220 and a source of the transistor 211. Also, for convenience of the explanation, the one end of the capacitor 220 (the gate of the driving transistor 210) is referred to as a node A. At the node A, a parasitic capacitance exists as shown by a dotted line in the FIG. 2. The capacitance is a parasitic capacitance between the node A and the cathode of the OLED element 230 and includes a gate capacitance of the driving transistor 210, a capacitance of the OLED element 230, and a parasitic capacitance of a wiring line located between the node A and the cathode.

The transistor 211 is electrically disposed between the drain and the gate of the driving transistor 210, and a gate of the transistor 211 is connected to the control line 104 of the i-th row. For this reason, the transistor 211 is turned on when the control signal $G_{SET-i}$ becomes H level and thus the driving transistor 210 serves as a diode.

On the other hand, one end (a drain) of the transistor 212 is connected to the feed line 116 and the other end (a source) thereof is connected to one end (a drain) of the transistor 213 and the other end of the capacitor 220. A gate of the transistor 212 is connected to the control line 106 of the i-th row. For this reason, the transistor 212 is turned on when the control signal $G_{INI-i}$ becomes H level.

Further, the other end (a source) of the transistor 213 is connected to the data line 112 of the j-th column and a gate thereof is connected to the scanning line 102 of the i-th row. For this reason, the transistor 213 is turned on when the scanning signal $G_{WRT-i}$ is H level so that (a voltage of) the data signal X-j supplied to the data line 112 of the j-th column is applied to the other end of the capacitor 220.

Here, for convenience of the explanation, the other end of the capacitor (the source of the transistor 212 and the drain of the transistor 213) is referred to as a node B.

Moreover, the pixel circuits 200 arranged in the matrix shape are formed on a transparent substrate such as glass, together with the scanning lines 102 or the data lines 112. For this reason, the driving transistor 210 or each of the transistors 211, 212, 213, and 214 is made of a TFT (a thin film transistor) formed by a polysilicon process. Also, the OLED element 230 has the anode (respective electrodes) made of a transparent electrode film such as ITO (Indium Tin Oxide), the cathode (a common electrode) made of a simplex metal film, such as aluminum or lithium, or a laminated film thereof, and a light-emitting layer interposed therebetween, which are formed on the substrate.

Figure 3:
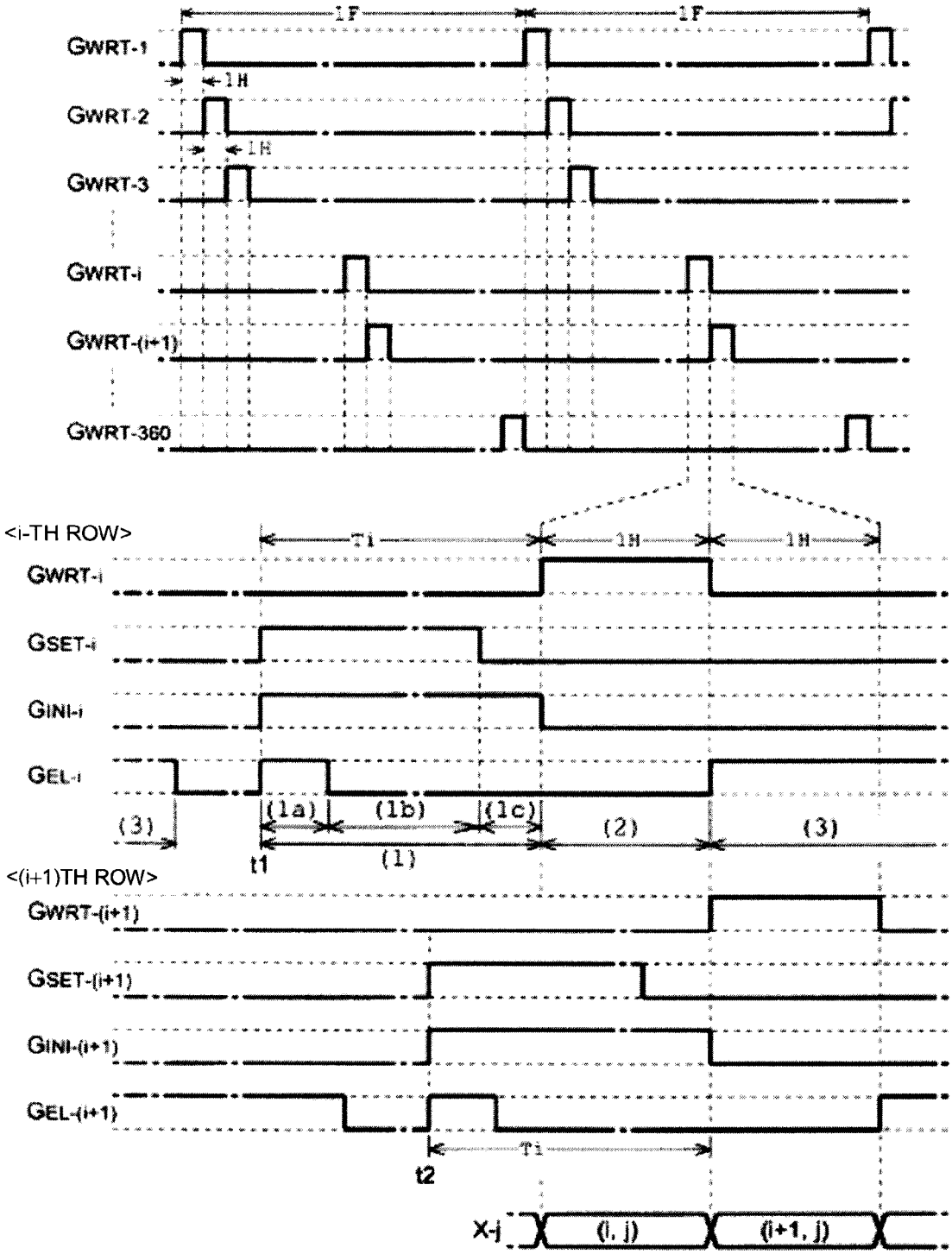
FIG. 3 is a timing chart showing the operation of the electro-optical device.

Next, the operation of the electro-optical device 10 will be explained. FIG. 3 is a timing chart illustrating the operation of the electro-optical device 10.

First, as shown in FIG. 3, in one vertical scanning period (1F), the Y driver 14 sequentially selects the scanning lines 102 of the 1st, 2nd, 3rd, . . . , and 360-th rows one by one for each horizontal scanning period (1H). In this case, only the scanning signal of the selected scanning line 102 becomes H level and the scanning signals of other scanning lines become L level.

Here, paying attention to one horizontal scanning period (1H) in which the scanning line 102 of the i-th row is selected and the scanning signal $G_{WRT-i}$ becomes H level, the operations in the horizontal scanning period will be described with reference to FIGS. 4 to 8, in addition to FIG. 3.

As shown in FIG. 3, at the timing t1 which precedes the timing at which the scanning signal $G_{WRT-i}$ varies to H level by a period Ti, the pre-preparation of the writing operation of the pixel circuit 200 in the i-th row and the j-th column starts. On the other hand, when the scanning signal $G_{WRT-i}$ varies from H level to L level again, light emission starts based on the written voltage.

For this reason, the operation of the pixel circuit 200 of the i-th row and the j-th column can be broadly divided into three period, that is, a fist period (1) from the timing t1 until the scanning signal $G_{WRT-i}$ varies varied to H level, a second period (2) in which the scanning signal $G_{WRT-i}$ becomes H level, and a third period (3) after the scanning signal $G_{WRT-i}$ varies to L level.

The first to third periods are referred to as (1) an initialization period, (2) a writing period, and (3) a light-emitting period, respectively, in consideration of the operation contents thereof. In the present embodiment, among them, the initialization period (1) can be divided into three periods (1*a*), (1*b*), and (1*c*).

Hereinafter, the operations of these periods will be described in order.

Figure 4:
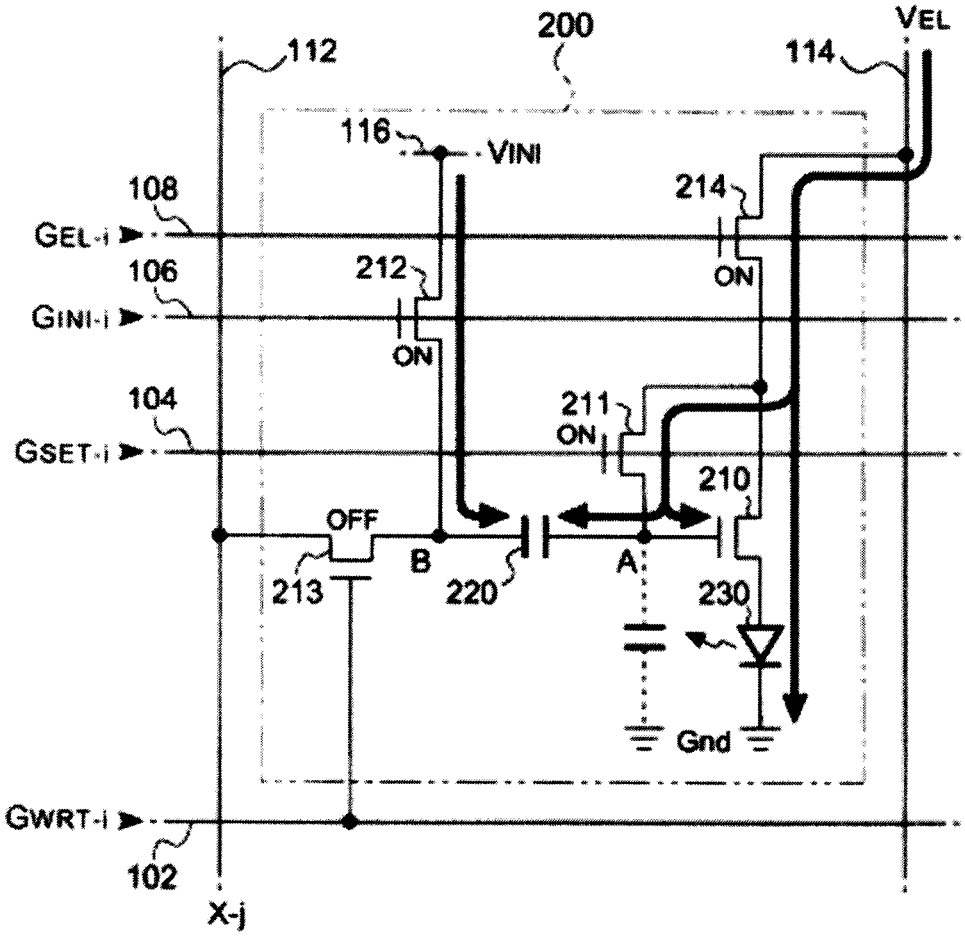
FIG. 4 is a diagram illustrating the operation of the pixel circuit.

First, before the timing t1, the scanning signal $G_{WRT-i}$, all the control signals $G_{SET-i}$, $G_{INI-i}$, and $G_{EL-i}$ are L level. If it reaches the timing t1, the initial period (1*a*) among the initialization period (1) comes, and the Y driver 14 sets the control signals $G_{SET-i}$, $G_{INI-i}$, and $G_{EL-i}$ to H level. For this reason, in the pixel circuit 200, as shown in FIG. 4, the transistor 211 is turned on by the control signal $G_{SET-i}$ having H level, and thus the driving transistor 210 serves as a diode. Further, the transistor 214 is also turned on by the control signal $G_{EL-i}$ having H level.

Accordingly, in the period (1*a*), a current flows into the pixel circuit 200 through a path of the power supply line 114, the transistor 214, the driving transistor 210, the OLED element 230, the ground Gnd in order, and thus the node A has a voltage according to the current, specifically, a gate voltage of the driving transistor 210 into which the current flows.

On the other hand, the control signal $G_{INI-i}$ becomes H level over the whole initialization period (1) to turn on the transistor 212. For this reason, the node B is fixed to an initial voltage $V_{INI}$ over the whole initialization period (1), and thus the voltage is held at the node A opposite to the node B as viewed from the capacitor 220. Accordingly, in the period (1*a*), the voltage according to the current flowing into the OLED element 230 is held at the node A.

Moreover, in the period (1*a*), the current flows into the OLED element 230, and thus the OLED element 230 emits. However, since the period (1*a*) is set to be short as it can be ignored as compared to one vertical scanning period (1F) which is a unit period for display, light emission in the period (1*a*) does not affect light emission in the light-emitting period (3) described below, that is, light emission caused by a required current flowing into the OLED element 230.

Figure 5:
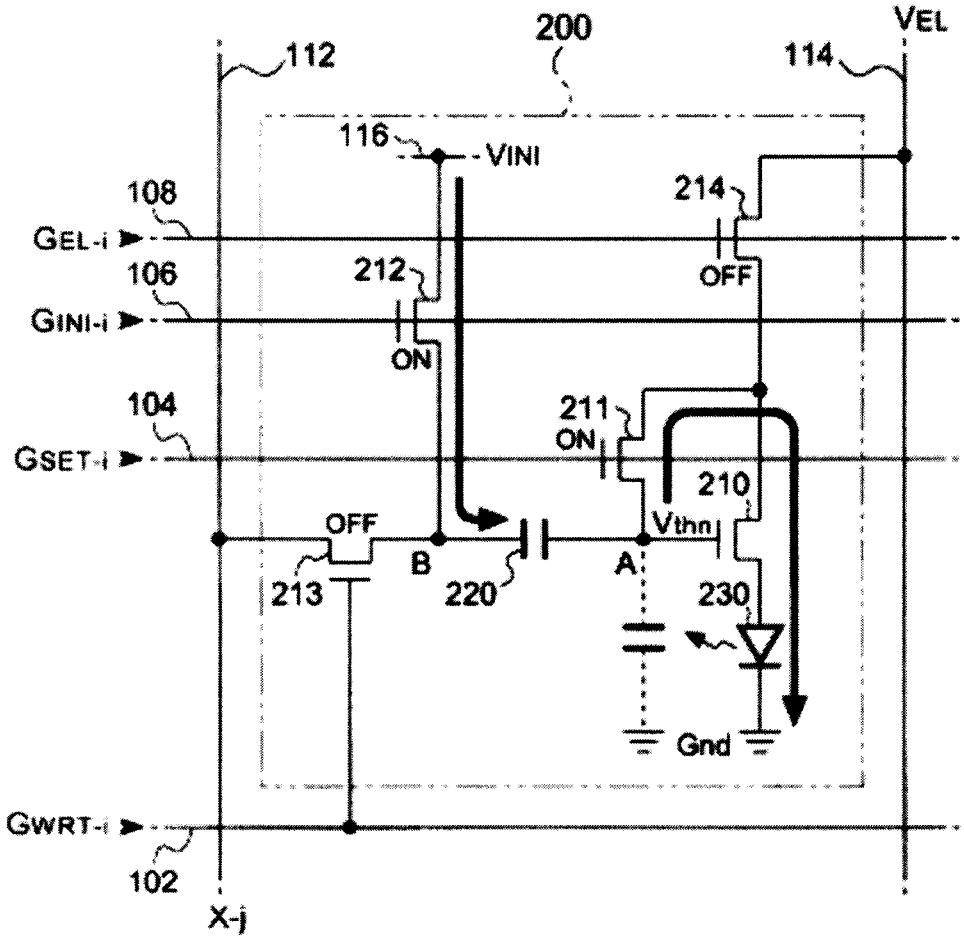
FIG. 5 is a diagram illustrating the operation of the pixel circuit.

Next, if it reaches the start timing of the period (1*b*) of the initialization period (1), the Y driver 14 returns the control signal $G_{EL-i}$ to L level and holds the control signals $G_{SET-i}$ and $G_{INI-i}$ at H level. For this reason, in the pixel circuit 200, as shown in FIG. 5, the transistor 214 is turned off, and thus the current path of the OLED element 230 is interrupted. However, the transistor 211 is turned on, and thus the driving transistor 210 continuously serves as the diode. For this reason, the voltage of the node A is gradually set toward a threshold voltage $V_{thn}$ of the driving transistor 210 in a self-compensation manner.

Thus, at the end timing of the period (1*b*), the voltage of the node A is approximately equal to the threshold voltage $V_{thn}$.

Figure 6:
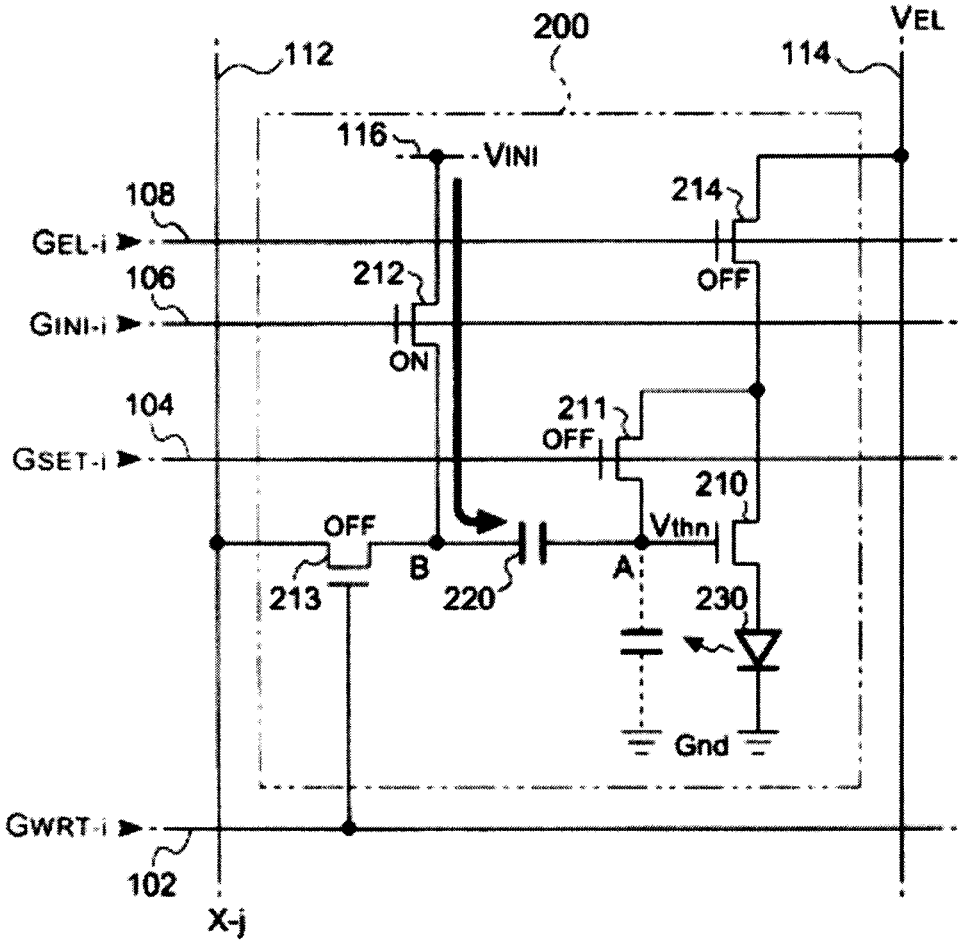
FIG. 6 is a diagram illustrating the operation of the pixel circuit.

Subsequently, at the start timing of the period (1*c*) in the initialization period (1), the Y driver 14 returns the control signal $G_{SET-i}$ to L level. For this reason, in the pixel circuit 200, as shown in FIG. 6, the diode connection of the driving transistor 210 is interrupted, and thus the voltage of the node A is set to $V_{thn}$.

Figure 7:
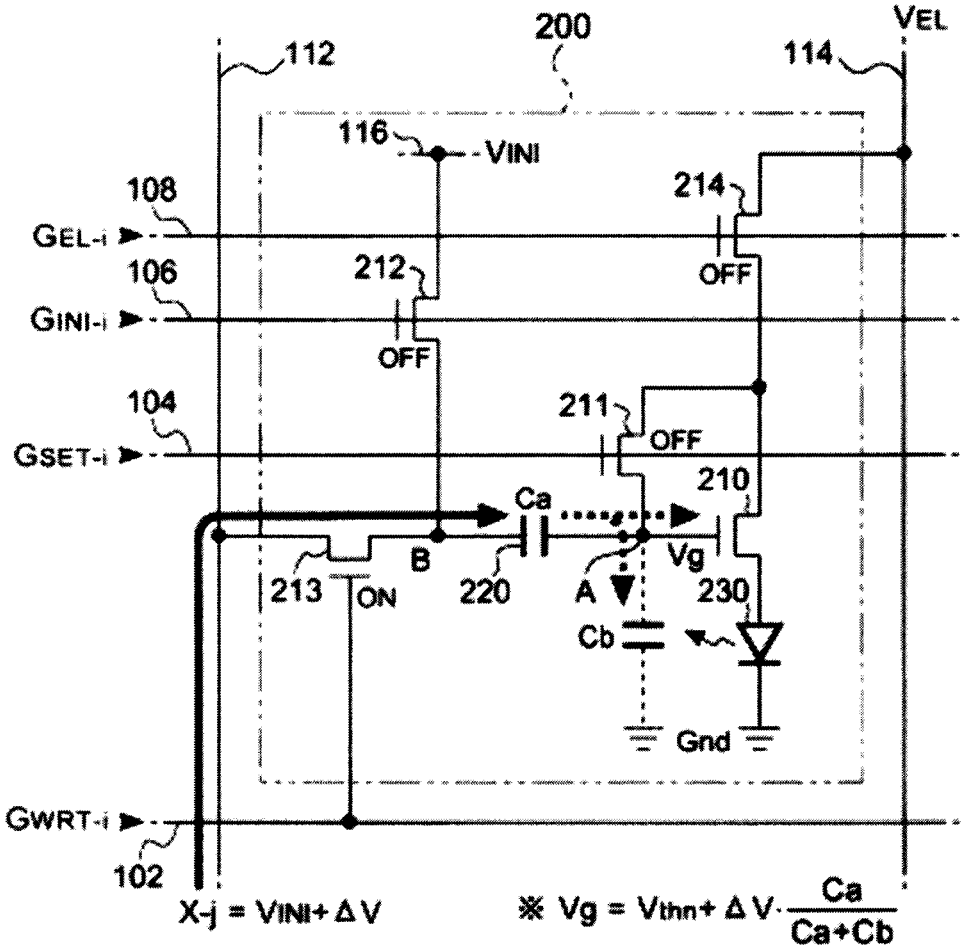
FIG. 7 is a diagram illustrating the operation of the pixel circuit.

Next, in the writing period (2), the Y driver 14 returns the control signal $G_{INI-i}$ to L level and sets the scanning signal $G_{WRT-i}$ to H level. For this reason, as shown in FIG. 7, the transistor 212 is turned off and the transistor 213 is turned on.

Moreover, in the writing period (2), the X driver 16 supplies the data signal X-j of the voltage according to the gray-scale level of the pixel of the i-th row and the j-th column to the data line 112 of the j-th column. As described above, the voltage of the data signal X-j for designating the lowest gray-scale level of the pixel is $V_{INI}$ and the voltage of the data signal X-j becomes high as the pixel becomes bright, and thus the voltage of the data signal X-j can be expressed as ($V_{INI}$+ΔV).

In addition, ΔV is the voltage variation (increment) from the initial voltage $V_{INI}$, becomes zero when designating the pixel to black of the lowest gray-scale level, and gradually becomes high as the gray-scale level becomes bright. Accordingly, the node B varies by ΔV from the initialization period (1) to the writing period (2).

On the other hand, during the writing period (2), in the pixel circuit 200, the transistor 211 is turned off, and thus the voltage of the node A is held only by the gate capacitance of the driving transistor 210. For this reason, the voltage of the node A increases from the voltage $V_{thn}$ of the initialization period (1) by the amount which is obtained by dividing the voltage variation ΔV by the capacitance ratio of the capacitor 220 and the gate capacitance of the driving transistor 210.

Specifically, when the capacitance of the capacitor 220 is Ca and the gate capacitance of the driving transistor 210 is Cb, the node A increases from the voltage $V_{thn}$ by {ΔV·Ca/(Ca+Cb)}. As a result, the voltage Vg of the node A can be expressed by the following equation.

$$Vg=V_{thn}+\Delta V\cdot Ca/(Ca+Cb) \quad \text{(a)}$$

Then, if it reaches the light-emitting period (3), the Y driver 14 sets the scanning signal $G_{WRT-i}$ to L level and sets the control signal $G_{EL-i}$ to H level.

Figure 8:
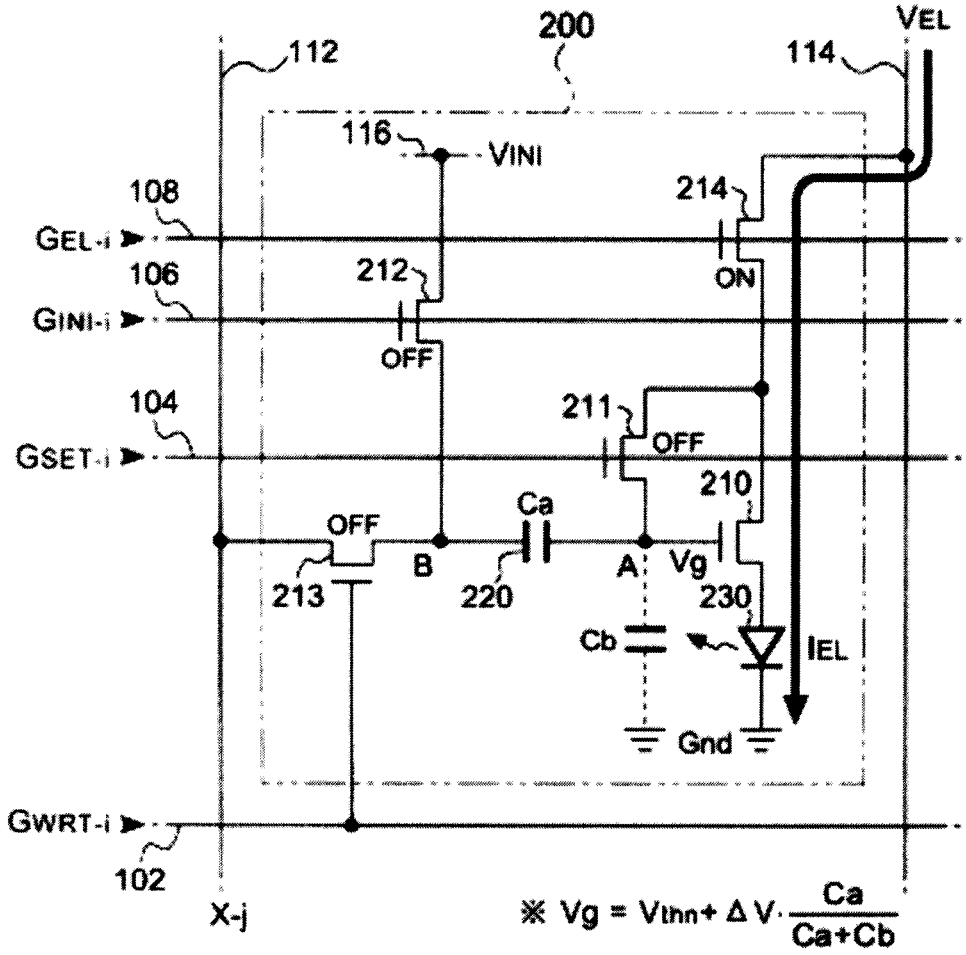
FIG. 8 is a diagram illustrating the operation of the pixel circuit.

For this reason, in the pixel circuit 200, as shown in FIG. 8, the transistor 213 is turned off, but the state of the voltage held in the capacitor 220 does not vary, and thus the voltage Vg is held at the node A. On the other hand, since the transistor 214 is turned on, a current $I_{EL}$ according to the voltage Vg flows in the current path of the OLED element 230. Accordingly, the OLED element 230 continuously emits with the brightness according to the current $I_{EL}$.

In the light-emitting period (3), the current $I_{EL}$ flowing into the OLED element 230 is determined by a conduction state between the source and the drain of the driving transistor 210, and the conduction state is set by the voltage of the node A. Here, since the gate voltage of the driving transistor 210 as viewed from the source thereof is the voltage Vg of the node A as it is, the current $I_{EL}$ is expressed by the following equation.

$$I_{EL}=(\beta/2)(Vg-V_{thn})^2 \quad \text{(b)}$$

Moreover, in this equation, β is a gain factor of the driving transistor 210.

Here, if the equation (a) is assigned to the equation (b), the following equation is obtained.

$$I_{EL}=(\beta/2)\{\Delta V\cdot Ca/(Ca+Cb)\}^2 \quad \text{(c)}$$

As shown in the equation (c), the current $I_{EL}$ flowing into the OLED element 230 is determined by only the variation ΔV from the initial voltage $V_{INI}$ (the capacitances Ca and Cb and the gain factor β are fixed values), without depending on the threshold value $V_{thn}$ of the driving transistor 210.

If the light-emitting period (3) continues during a predetermined period, the Y driver 14 sets the control signal $G_{EL-i}$ to L level. Accordingly, the transistor 214 is turned off, and thus the current path is interrupted and the OLED element 230 is lit out.

Here, the Y driver 14 controls the H level periods of the control signals $G_{EL-1}$ to $G_{EL-360}$ corresponding to the 1st row to the 360-th row to be equal to each other. Specifically, for all the OLED elements 230, the occupied ratio of the light-emitting period (3) in one vertical scanning period is controlled to be uniform. For this reason, if the light-emitting period (3) becomes long, the entire screen becomes bright. Further, if the light-emitting period (3) becomes short, the entire screen becomes dark.

Moreover, the maximum length of the light-emitting period (3) is the whole period of one vertical scanning period (1F) except for the initialization period (1) and the writing period (2). For this reason, in a case of the i-th row, the control signal $G_{EL-i}$ can be H level from the timing at which the scanning signal $G_{WRT-i}$ varies from H level to L level to the timing t1 preceding by the period Ti the timing that the scanning line 102 of the i-th row is selected again after one vertical scanning period (1F) has passed.

Here, the operation of the pixel circuit 200 of the i-th row and the j-th column is described, but, for other pixels in the i-th row, all the operations of the initialization period (1), the writing period (2), and the light-emitting period (3) are simultaneously performed in parallel.

Also, although the present embodiment is described with paying attention to the i-th row, for the first to 360-th rows, the scanning lines 102 are sequentially selected for each horizontal scanning period (1H) and the operation of the writing period (2) is performed in the selected period. Then, before the writing period (2), the initialization period (1) is performed, and, after the writing period (2), the light-emitting period (3) is performed. For example, for the (i+1)th row subsequent to the i-th row, as shown in FIG. 3, the initialization period (1) is performed at the timing t2 preceding the timing that the scanning signal $G_{WRT-(i+1)}$ becomes H level by the period Ti and then the writing period (2) is performed in a period that the scanning signal $G_{WRT-(i+1)}$ becomes H level. In the writing period of the (i+1)th row, the data line 112 of the j-th column is supplied with the data signal X-j of the voltage according to the gray-scale level of the pixel of the (i+1)th row and the j-th column, and the voltage variation thereof is written onto the node A. Then, the light-emitting period (3) comes.

Accordingly, the initialization period (1) may be performed over at least two adjacent rows in parallel. Similarly, the light-emitting period (3) may also be performed over at least two adjacent rows in parallel.

According to the first embodiment, in the period (1*a*) of the initialization period (1), the driving transistor 210 is brought into diode connection and the current forcibly flows into the OLED element 230. Accordingly, the node A has the voltage according to the current and the node B is fixed to the initial voltage $V_{INI}$. For this reason, the node A reaches a certain voltage and the certain voltage is held at the node A. Thereafter, in a state in which the diode connection is maintained, the transistor 214 is turned off, and the voltage of the node A is shifted to $V_{thn}$ tile the end timing of the period (1*b*). Then, in the period (1*c*), the voltage of the node A is determined to $V_{thn}$. Since the initialization period (1) is a period that has no relation to the writing period (2) in which the row is selected and is performed earlier than the writing period, the sufficiently long period can be ensured in one vertical scanning period (1F).

Next, in the writing period (2), the data signal X-j is applied to the node B to vary the voltage of the other end of the capacitor 220 and, through the division of the charges due to the voltage variation, the voltage according to the current flowing into the OLED element 230 is written into the gate of the driving transistor 210. For this reason, while ensuring the initialization period (1), the time required for writing the voltage can be reduced, as compared to the method in which the voltage according to the current flowing into the OLED element 230 is directly written onto the gate of the driving transistor 210.

Further, in the light-emitting period (3), the current flowing into the OLED element 230 does not depend on the threshold voltage $V_{thn}$ of the driving transistor 210. For this reason, for each pixel circuit 200, the current flowing into the OLED element 230 can be arranged uniformly, even when the threshold voltage $V_{thn}$ of the driving transistor 210 is deviated.

Accordingly, according to the electro-optical device of the first embodiment, even when the number of the pixels increases accompanying with high resolution, the writing time of the data signal becomes short and uniformity of the current flowing into the OLED element 230 can be ensured.

Moreover, in the pixel circuit 200 according to the first embodiment, when the transistor 211 is turned on, the driving transistor 210 is brought into diode connection. In contrary, when the transistor 214 is turned off, the current path of the driving transistor 210 and the OLED element 230 is blocked. These are completely different from each other. For this reason, in the first embodiment, as shown in FIG. 2, the transistor 211 is turned on or off by the control line 104 and the transistor 214 is turned on or off by the control line 108, respectively.

Figure 9:
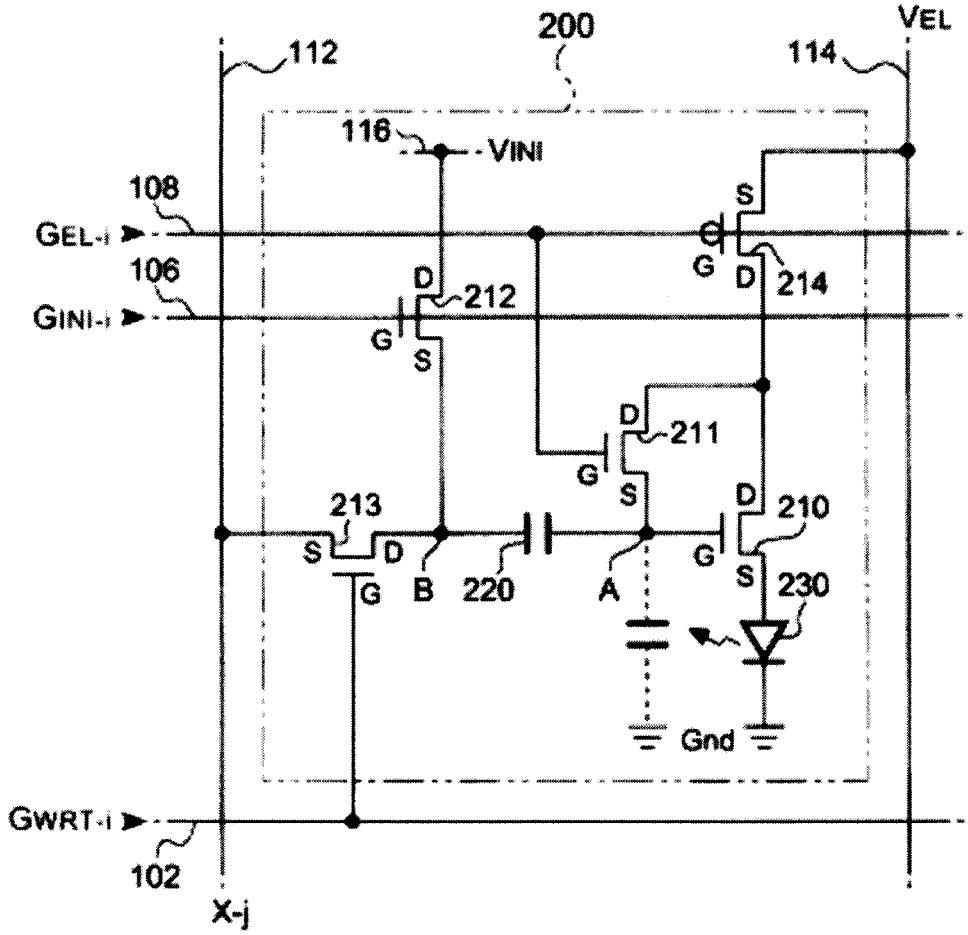
FIG. 9 is a diagram showing another configuration of the pixel circuit.

However, as shown in FIG. 9, for example, when the conductivity type of the transistor 214 changes into a p-channel type, the transistors 211 and 214 have different channel types, and thus they may be turned on or off by the common control line 108. If this configuration is employed, the control line 104 is not required, and thus the control line is reduced by one for each row, as compared to the configuration of FIG. 2. As a result, a yield can be enhanced and a bright display having a high aperture ratio can be performed in a case of a bottom emission type.

Further, if the transistors 211 and 212 are the same channel type, the threshold voltages of the transistors 211 and 212 are equal to each other, and thus the operation thereof can be surely controlled by the same control signal $G_{INI-i}$ as compared to the case in which the transistors are different channel types. For example, with respect to the same control signal $G_{INI-i}$, an erroneous operation that one transistor is turned on and the other transistor is turned off can be prevented. Further, when the transistors are the same channel type, the margin for the implantation of the impurity into the transistor is not required, and thus the transistor 211 and the transistor 212 can be arranged to be close to each other. Accordingly, the occupied area of the transistor in the pixel region can be reduced to the minimum and the transistor 211 and the transistor 212 can be manufactured without causing a deviation in transistor characteristic. Further, if the driving transistor 210 is the same channel type as those of the transistor 211 and the transistor 212, the same advantages can be obtained. Further, since the voltage range of the power supply for the signal supplied to the pixel circuit can be minimized by using only the same channel type, the electronic circuit having high reliability can be implemented.

<Second Embodiment>

Figure 10:
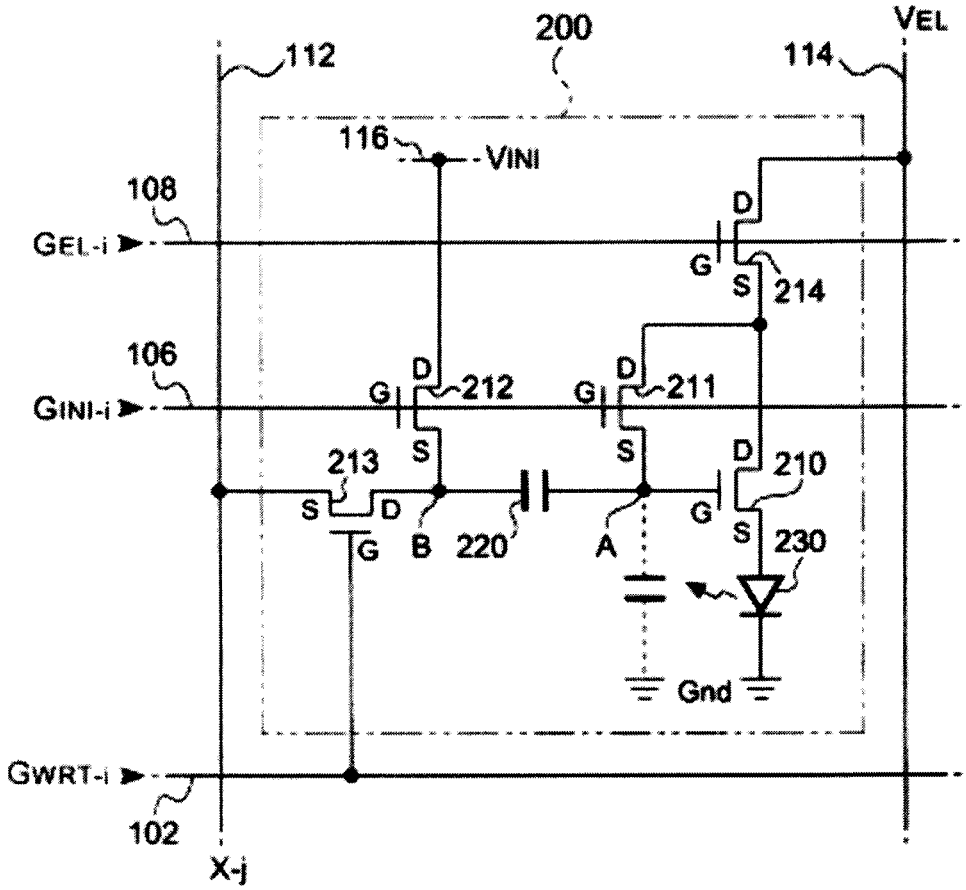
FIG. 10 is a diagram showing a pixel circuit of an electro-optical device according to a second embodiment of the present invention.

Next, an electro-optical device according to a second embodiment of the present invention will be described. In the electro-optical device according to the second embodiment, a pixel circuit 200 shown in FIG. 10 is substituted for the pixel circuit of the first embodiment.

In the pixel circuit 200 shown in FIG. 2, the transistors 211 and 212 are turned on or off by the control signals $G_{SET-i}$ and $G_{INI-i}$, respectively. In the pixel circuit shown in FIG. 10, however, the transistors 211 and 212 are commonly turned on or off by the control signal $G_{INI-i}$ supplied to the control line 106.

Figure 11:
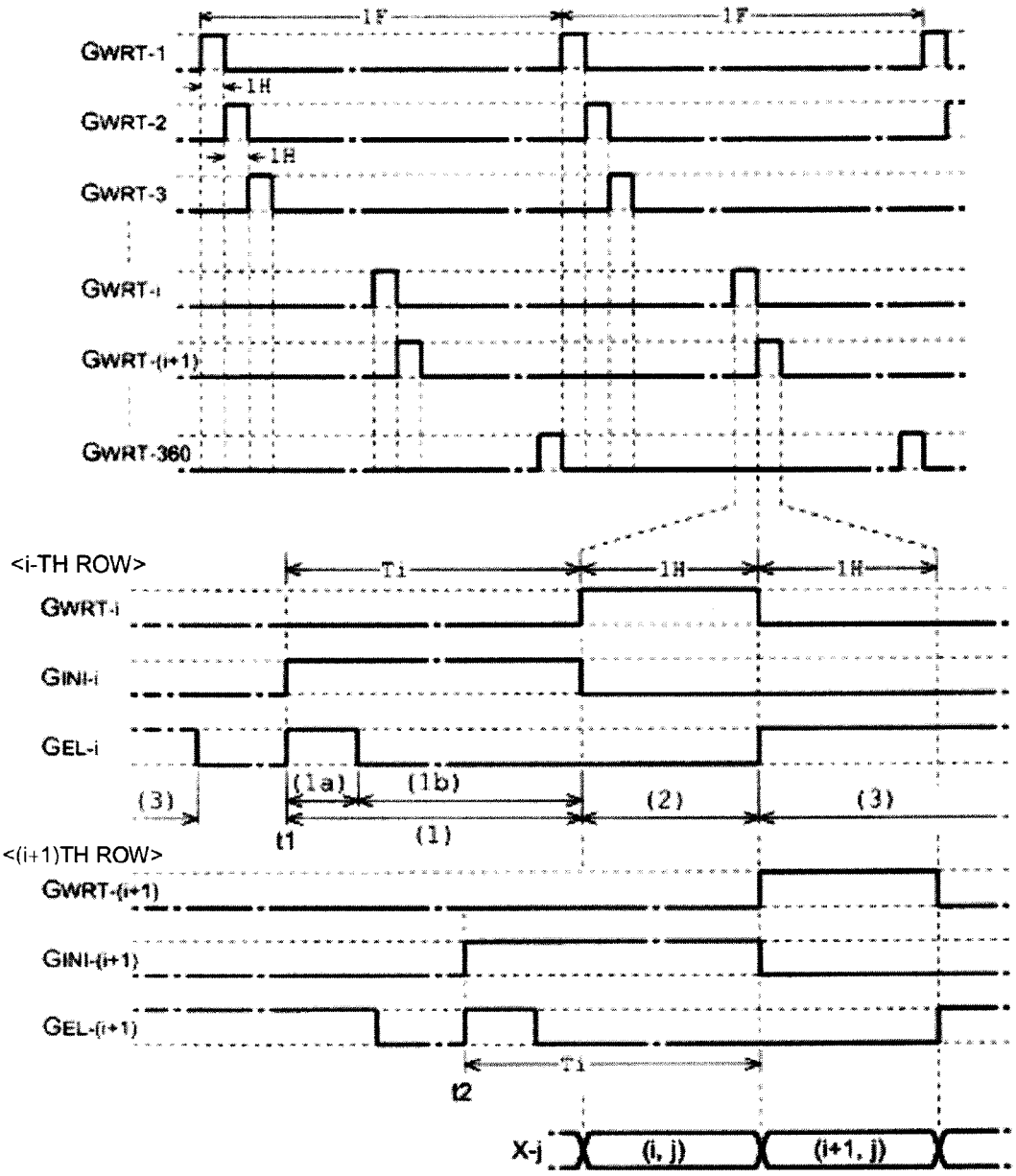
FIG. 11 is a timing chart showing the operation of the electro-optical device.

FIG. 11 is a timing chart illustrating the operation of the electro-optical device according to the second embodiment.

As shown in FIG. 11, in the second embodiment, since the transistors 211 and 212 are commonly turned on or off by the control signal $G_{INI-i}$, the initialization period (1) does not include the period (1*c*). However, in the pixel circuit 200 shown in FIG. 10, since the transistors 211 and 212 are simultaneously turned off at the end timing of the period (1*b*), the voltage of the node A is determined simultaneously with the end timing of the initialization period (1*b*).

Moreover, other operations thereof are the same as those in the first embodiment, and thus the descriptions thereof will be omitted.

According to the electro-optical device according to the second embodiment, like the pixel circuit shown in FIG. 9, the control line 104 is not required, and thus the control line is reduced by one for each row. Thus, the yield or the aperture ratio can be enhanced.

<Third Embodiment>

Next, an electro-optical device according to a third embodiment of the present invention will be described. In the electro-optical device according to the third embodiment, a pixel circuit 200 shown in FIG. 12 is substituted for the pixel circuit of the first embodiment.

Figure 12:
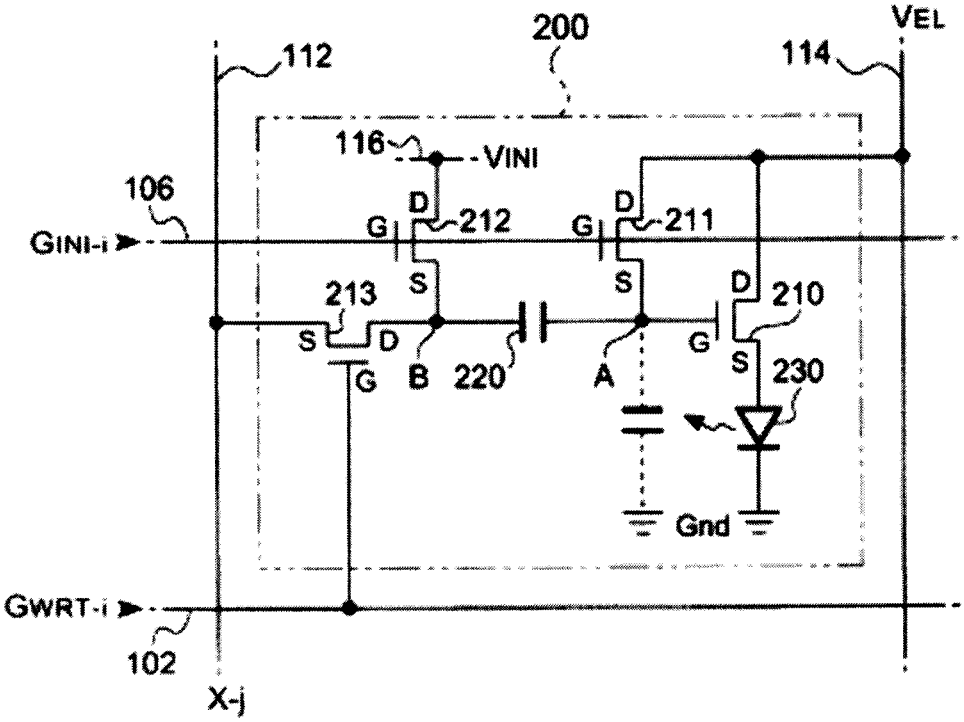
FIG. 12 is a diagram showing a pixel circuit of an electro-optical device according to a third embodiment of the present invention.

The pixel circuit 200 shown in FIG. 12 has the configuration in which the transistor 214 is removed from the pixel circuit shown in FIG. 10. Accordingly, in the pixel circuit 200 shown in FIG. 12, the control line 108 is not required.

Figure 13:
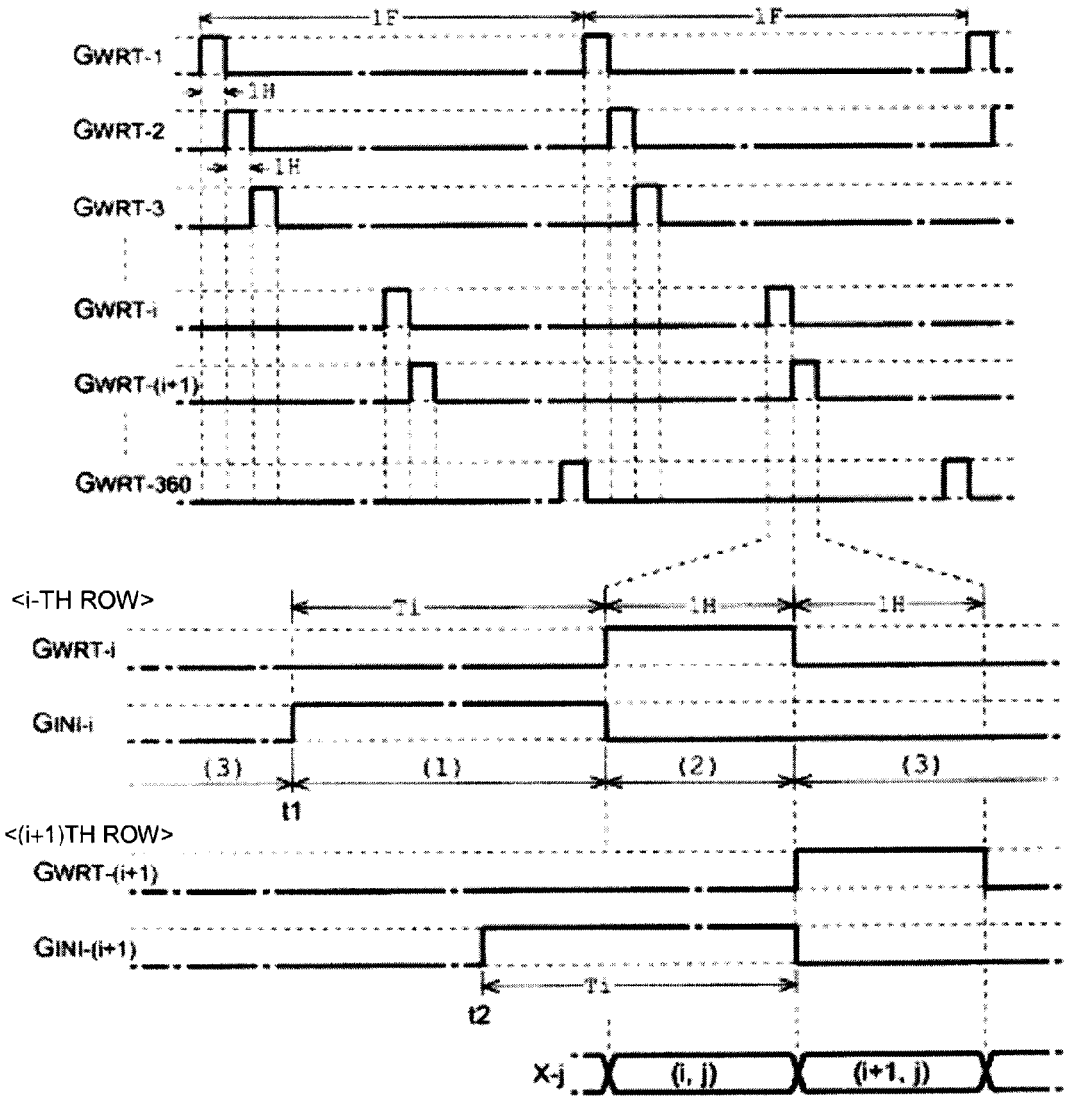
FIG. 13 is a timing chart showing the operation of the electro-optical device.

FIG. 13 is a timing chart illustrating the operation of the electro-optical device according to the third embodiment of the present invention.

As shown in FIG. 13, in the third embodiment, in the case of the i-th row, earlier than the writing period (2) in which the scanning signal $G_{WRT-i}$ becomes H level, the initialization period (1) in which the control signal $G_{INI-i}$ becomes H level by the period Ti is provided.

Since the transistors 211 and 212 are simultaneously turned on in the initialization period (1), the current flows into the driving transistor 210 (brought into diode connection) and the OLED element 230. Then, the control signal $G_{INI-i}$ becomes L level and the transistors 211 and 212 are simultaneously turned off at the end timing of the initialization period (1). Thus, like the first and second embodiments, the driving transistor 210 maintains diode connection, and thus the voltage shift of the self-compensatory node A is prevented.

For this reason, at the end timing of the initialization period (1), the node A has the voltage according to the current flowing into the OLED element 230, to which the threshold voltage $V_{thn}$ of the driving transistor 210 is reflected, and becomes high as compared to the first and second embodiments. Therefore, in the third embodiment, as the voltage of the node A becomes high, the initial voltage $V_{INI}$ supplied through the feed line 116 is also set to a high value.

Specifically, the third embodiment is the same as the first and second embodiments in that the initial voltage $V_{INI}$ is the reference voltage when the voltage of the node B varies from the initialization period (1) to the writing period (2) and the voltage according to the voltage variation is written onto the node A in the writing period (2). However, in the third embodiment, a voltage point of the node A in the initialization period (1) is high, and thus, if the initialization voltage $V_{INI}$ is set to the low value like the first and second embodiments, the voltage of the node A only increases from the high voltage point in the writing period (2), it is impossible to allow the current corresponding to the low gray-scale level (dark gray-scale level) to flow into the OLED element 230 by writing the low voltage onto the node B. Therefore, in the third embodiment, it is constructed that the voltage of the node B may be increased or decreased from the initialization period (1) to the writing period (2) by setting the initial voltage $V_{INI}$ to the high value as compared to the first and second embodiments.

Then, in this configuration, in a case in which the current corresponding to the low gray-scale level (dark gray-scale level) flows into the OLED element 230, the voltage of the node B decreases (discharge) from the initialization period (1) to the writing period (2) and the voltage according to the decrement is written onto the node A. Thus, the voltage of the node B decreases, and thus the current corresponding to the low gray-scale level (dark gray-scale level) can flow into the OLED element 230.

Moreover, the initial voltage $V_{INI}$ in the third embodiment corresponds to the voltage of the data signal for designating the intermediate gray-scale level (gray) between the lowest gray-scale level (black) and the highest gray-scale level (white) of the pixel.

According to the electro-optical device according to the third embodiment, the control line 104 is not required as compared to the pixel circuit shown in FIG. 9 or 10, and thus the control line is reduced by one (two as compared to the pixel circuit of FIG. 2) for each row and the number of the transistors per one pixel circuit is reduced by one. Thus, the yield and the aperture ratio can be further increased.

However, in the third embodiment, since there is no transistor 214, the brightness of the entire screen cannot be adjusted by controlling the light-emitting period (3). Also, in the writing period (2), the current according to the voltage of the node A flows into the OLED element 230.

<Fourth Embodiment>

Next, an electro-optical device according to a fourth embodiment of the present invention will be described. In the electro-optical device according to the fourth embodiment, a pixel circuit 200 shown in FIG. 14 is substituted for the pixel circuit of the first embodiment.

Figure 14:
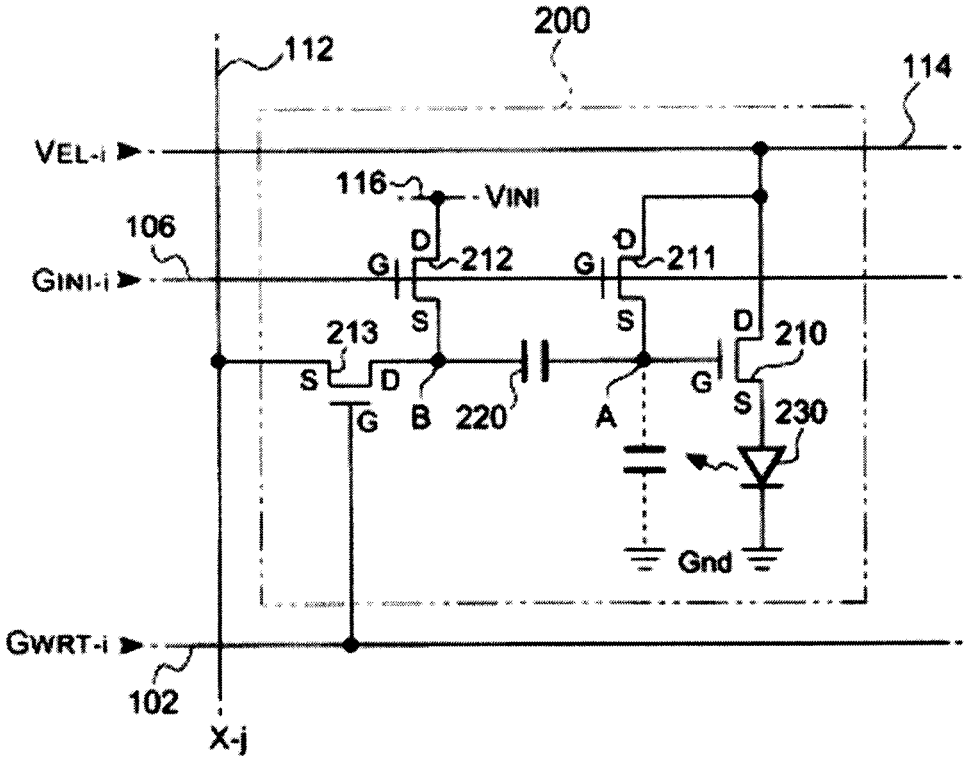
FIG. 14 is a diagram showing a pixel circuit of an electro-optical device according to a fourth embodiment of the present invention.

The pixel circuit 200 shown in FIG. 14 has the configuration in which the power supply line 114 is arranged in the X direction for each row and the voltage thereof varies as the time passes, in the pixel circuit shown in FIG. 12. That is, the power supply line 114 in the fourth embodiment is common to the pixels for one row, together with the scanning line 102 and the control line 106.

The power supply line 114 is driven by, for example, the Y driver 14. Further, in the fourth embodiment, the initial voltage $V_{INI}$ applied to the feed line 116 is the voltage equal to the data signal for designating the lowest gray-scale level of the pixel, like the first and second embodiments.

Figure 15:
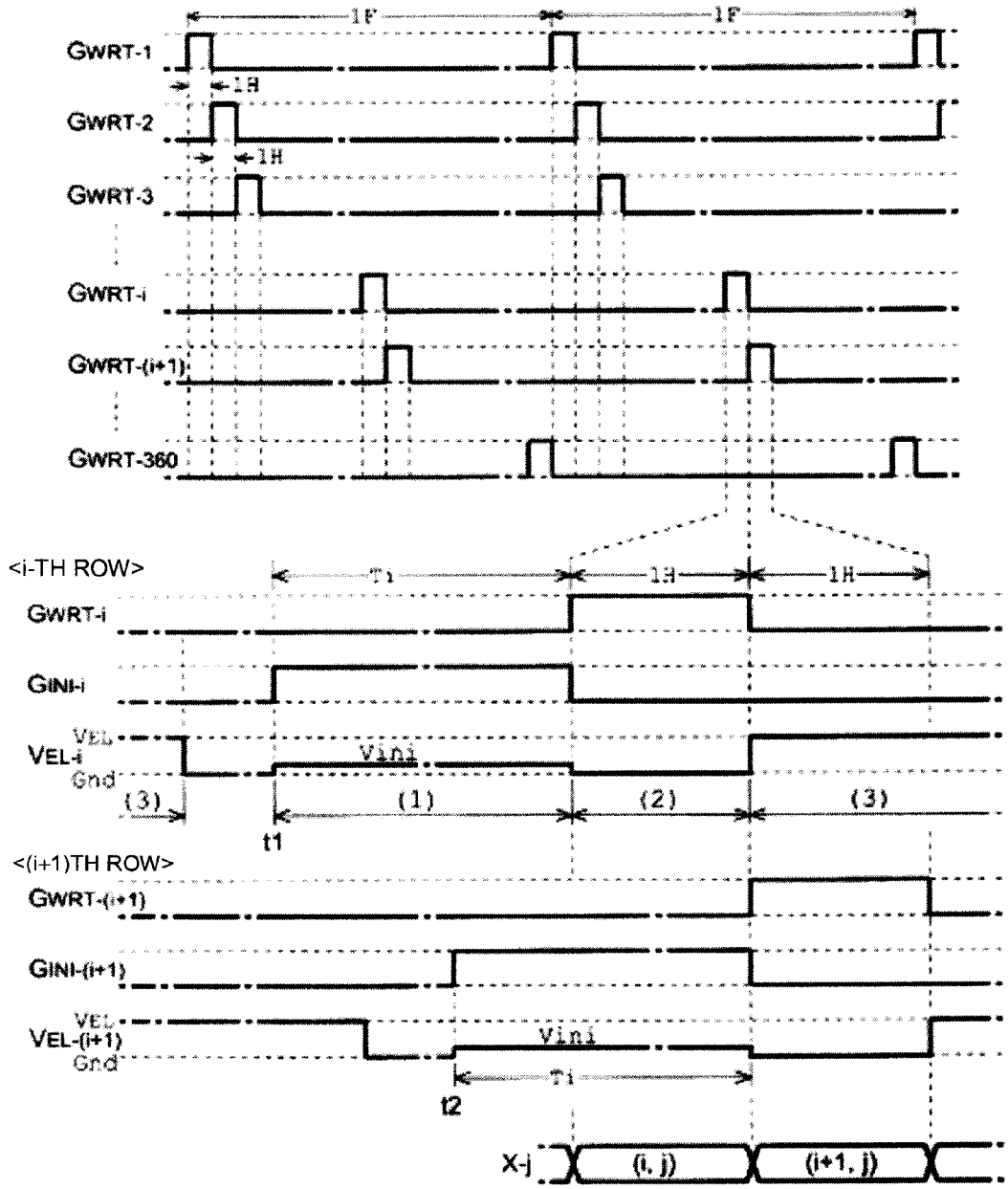
FIG. 15 is a timing chart showing the operation of the electro-optical device.

FIG. 15 is a timing chart illustrating the operation of the electro-optical device according to the fourth embodiment.

As shown in FIG. 15, in the fourth embodiment, in the case of the i-th row, the control signal $G_{INI-i}$ becomes H level by the period Ti in the initialization period which is earlier than the writing period (2) in which the scanning signal $G_{WRT-i}$ becomes H level, like the third embodiment.

However, according to the fourth embodiment, in the initialization period, the Y driver 14 sets the voltage $V_{EL-i}$ of the power supply line 114 of the i-th row to the initial voltage $V_{ini}$. The initial voltage $V_{ini}$ is the voltage which is somewhat higher than the sum of the threshold voltage $V_{thn}$ of the driving transistor 210 and the threshold voltage of the OLED element 230. Specifically, in a case in which the initial voltage $V_{ini}$ is applied to the drain of the driving transistor 210 which is brought into diode connection when the transistor 211 is turned on, the voltage is one which allows the very small current to flow into the driving transistor 210 and the OLED element 230.

On the other hand, according to the fourth embodiment, in the initialization period (1), the initial voltage $V_{INI}$ of the node B is fixed when the transistor 212 is turned on, and thus the voltage according to the current is held at the node A.

Here, since the current flowing into the OLED element 230 in the initialization period (1) is very small, unlike the third embodiment, the voltage held at the node A can be substantially set to the threshold value $V_{thn}$ of the driving transistor.

Next, if it reaches the writing period (2), the Y driver 14 decreases the voltage $V_{EL-i}$ to Gnd and sets the control signal $G_{WRT-i}$ to H level. Accordingly, since the transistor 213 is turned on, the voltage of the node B varies by ΔV and the voltage of the node A increases by the amount which is obtained by dividing the variation by the capacitance ratio. Accordingly, like the first embodiment, in order to allow the current to flow into the OLED element 230, the gate voltage can be written onto the node A.

Subsequently, if it reaches the light-emitting period (3), the Y driver 14 sets the voltage $V_{EL-i}$ to the power supply voltage $V_{EL}$ and sets the control signal $G_{WRT-i}$ to L level. Accordingly, like the first embodiment, the current according to the voltage of the node A flows into the OLED element 230 and the OLED element 230 emits with the brightness according to the current.

Then, when the light-emitting period (3) ends, the Y driver 14 decreases the voltage $V_{EL-i}$ to Gnd. Accordingly, the OLED element 230 is lit out, and thus the light-emitting period (3) is adjusted.

According to the electro-optical device according to the fourth embodiment, like the third embodiment, the control line 108 is not required as compared to the pixel circuit shown in FIG. 9 or 10, and thus the control line is reduced by one (two as compared to the pixel circuit of FIG. 2) for each row and the number of the transistors per one pixel circuit is reduced by one. Thus, the yield and the aperture ratio can be further increased. Further, according to the fourth embodiment, the light-emitting period (3) can be adjusted and the brightness of the entire display screen can be varied, unlike the third embodiment.

Moreover, in the fourth embodiment, the power supply line 114 is arranged in the X direction for each row of the scanning line 102, but one power supply line may be arranged for every adjacent rows and that may be common to the pixel circuit 200 of the plurality of rows. According to this configuration, the number of the wiring lines can be reduced, and thus, in particular, it is advantageous in terms of the aperture ratio.

<Fifth Embodiment>

Next, an electro-optical device according to a fifth embodiment of the present invention will be described. In the electro-optical device according to the fifth embodiment, a pixel circuit 200 shown in FIG. 16 is substituted for the pixel circuit of the first embodiment.

Figure 16:
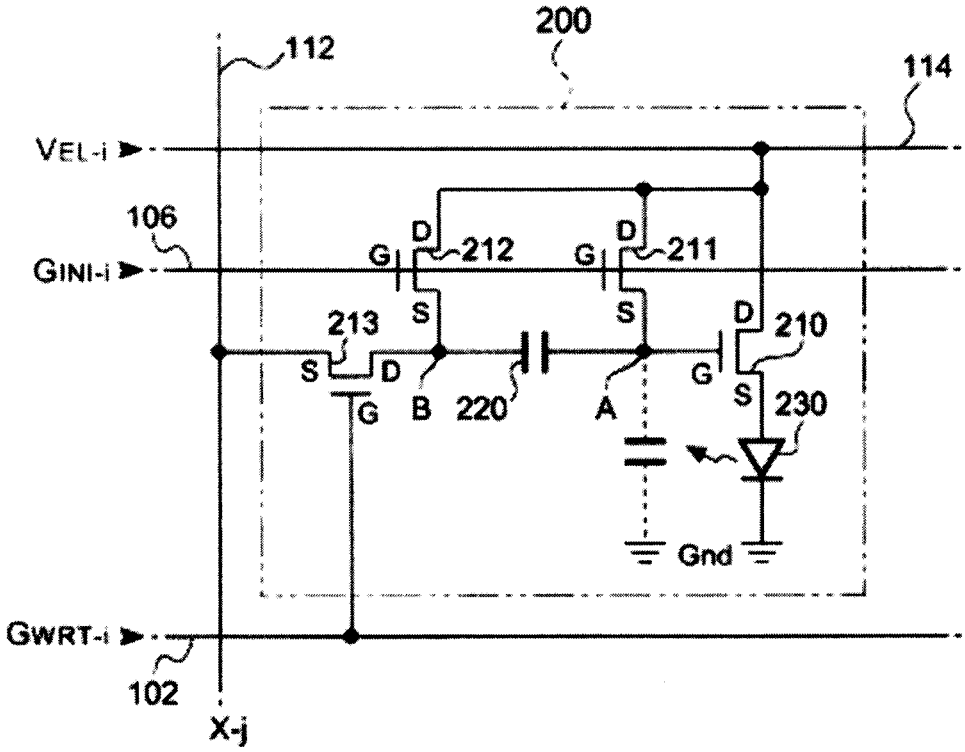
FIG. 16 is a diagram showing a pixel circuit of an electro-optical device according to a fifth embodiment of the present invention.

As shown in FIG. 16, the pixel circuit 200 of the fifth embodiment has the configuration in which, in the pixel circuit shown in FIG. 14, the one end (the drain) of the transistor 212 is connected to the power supply line 114 for each row, instead of the feed line 116.

Moreover, the operations of the electro-optical device according to the fifth embodiment are equal to those in the fourth embodiment, except that the node B is fixed to the initial voltage $V_{ini}$ of the power supply line 114 in the initialization period (1), and thus the descriptions thereof will be omitted.

According to the fifth embodiment, since the feed line 116 is not required, it is advantageous in terms of the yield and the aperture ratio as compared to the fourth embodiment.

The present invention is not limited to the above-described first to fifth embodiments, various modifications can be made.

Figure 17:
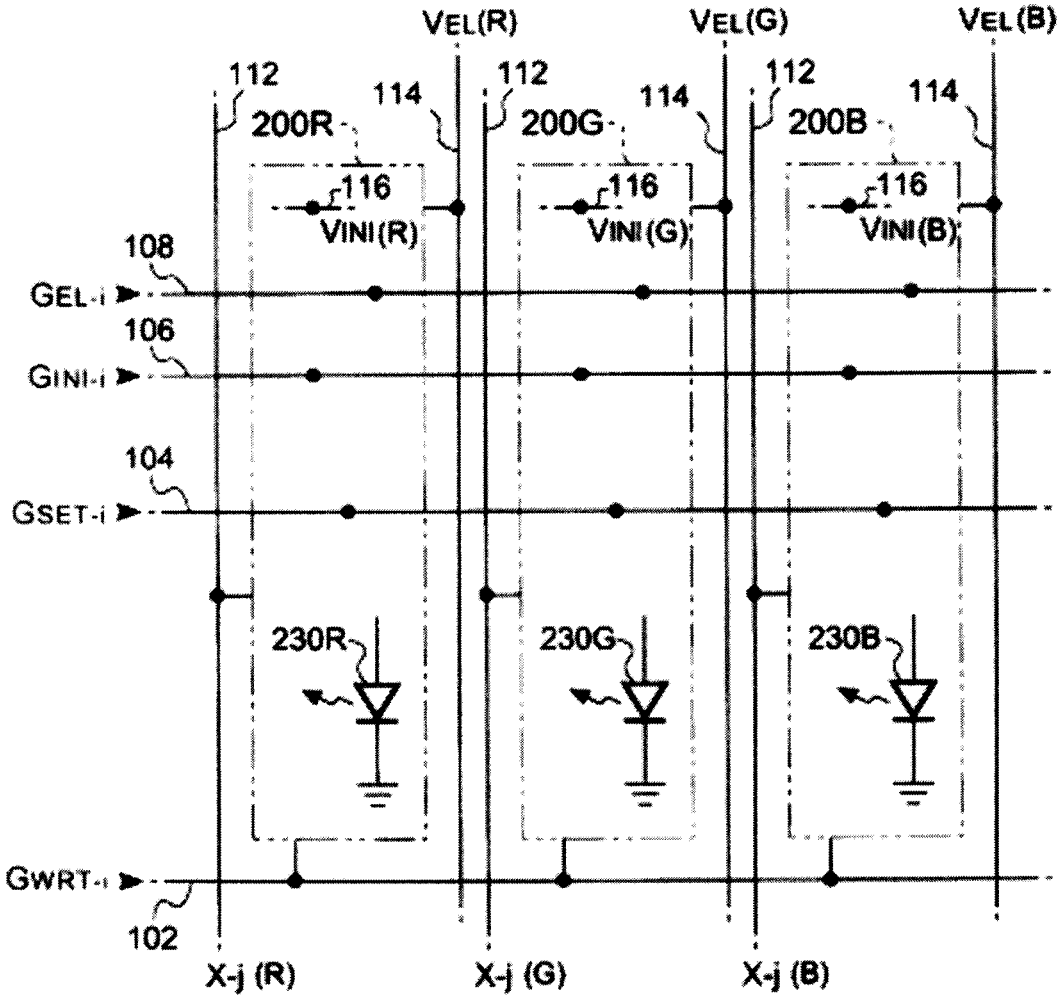
FIG. 17 is a diagram showing a configuration for color display which uses the electro-optical device according to the respective embodiments.

For example, in the respective embodiments described above, the configuration for gray-scale level display of the single-color pixel is described, but, color display can be performed by arranging the pixel circuits 200R, 200G, and 200B to correspond to R (red), G (Green), and B (Blue) and by forming one dot with the three pixels, as shown in FIG. 17. Further, in the case of color display, the OLED elements 230R, 230G, and 230B select the light-emitting layers to respectively emit red, green, and blue.

As such, in the configuration for color display, if light-emitting efficiencies of the OLED elements 230R, 230G, and 230B are different from each other, the power supply voltage $V_{EL}$ and the initial voltage $V_{INI}$ must be different for each color.

However, as shown in FIG. 17, the scanning line 102 and the control lines 104, 106, and 108 can be commonly used.

Moreover, FIG. 17 shows an example of a configuration in a case in which color display is performed using the first embodiment (see FIG. 2). It is needless to say that color display can be performed using FIG. 9, the second embodiment (see FIG. 10), the third embodiment (see FIG. 12), the fourth embodiment (see FIG. 14), or the fifth embodiment (see FIG. 16).

In addition, although the initialization period (1) and the writing period (2) are consecutive over time in the respective embodiments, as shown in FIGS. 3, 11, 13, and 15, both periods may be separated from each other over time. Similarly, the writing period (2) and the light-emitting period (3) may be separated from each other over time.

Further, in the configurations of FIGS. 2, 9, 10, 14, and 16, in addition to the light-emitting period (3), the current according to the voltage of the node A may flow into the OLED element 230 by setting the control signal $G_{EL-i}$ to H level or by setting the voltage $V_{EL-i}$ set to the voltage $V_{EL}$ in the writing period (2).

Although the n-channel type driving transistor 210 is used in the respective embodiments, a p-channel driving transistor may be used. Also, the same is applied to the channel types of the transistors 211, 212, 213, and 214. However, in the case of the configuration of FIG. 9, one of the transistors 211 and 214 is a p-channel transistor and the other is an n-channel type, as described above. Further, in the case of the configuration shown in FIG. 10, 12, 14, or 16, the transistors 211 and 212 are simultaneously turned on or off by the common control line 106, the types thereof must be unified to any one of the p-channel type and the n-channel type.

In addition, the respective transistors may be made of a transmission gate in which the p-channel types and the n-channel types are complementarily combined, such that the voltage can be reduced as it can be ignored.

In addition, the OLED element 230 may be connected to the drain of the transistor 214, instead of the source of the transistor 214.

Moreover, the OLED element 230 is an example of the current-driven element. Alternatively, other light-emitting elements such as an inorganic EL element, a field emission (FE) element, or a LED may be used. Further, an electrophoretic element or electrochromic element may be used.

Next, an example in which the electro-optical device according to the above-described embodiments is applied to the electronic apparatus will be described.

Figure 18:
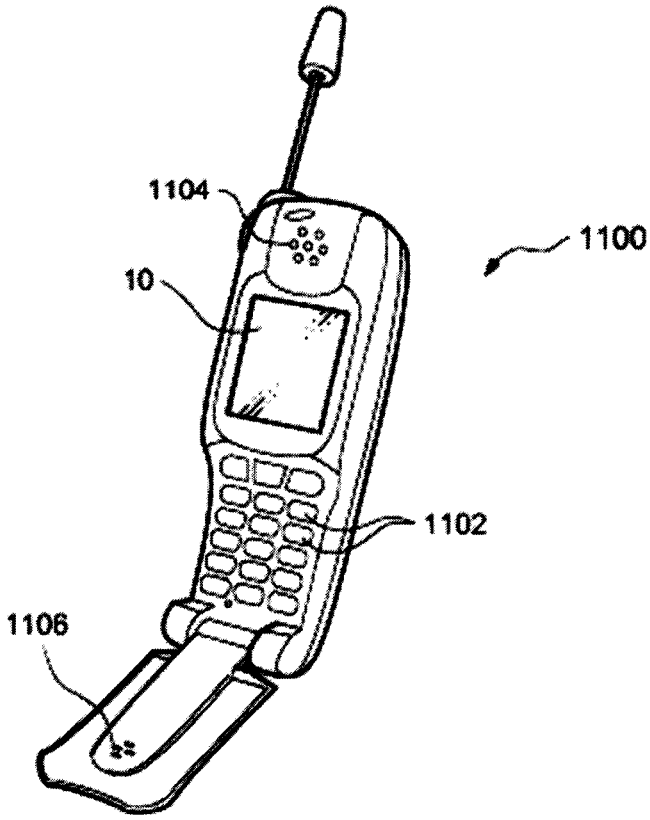
FIG. 18 is a diagram showing a cellular phone which uses the electro-optical device.

First, a cellular phone in which the above-described electro-optical device 10 is used as a display unit will be described. FIG. 18 is a perspective view showing the configuration of the cellular phone.

In FIG. 18, the cellular phone 1100 has a plurality of operating buttons 1102, a receiver 1104, a transmitter 1106, and the above-described electro-optical device 10 as the display unit.

Next, a digital still camera in which the above-described electro-optical device 10 is used for a finder will be described.

Figure 19:
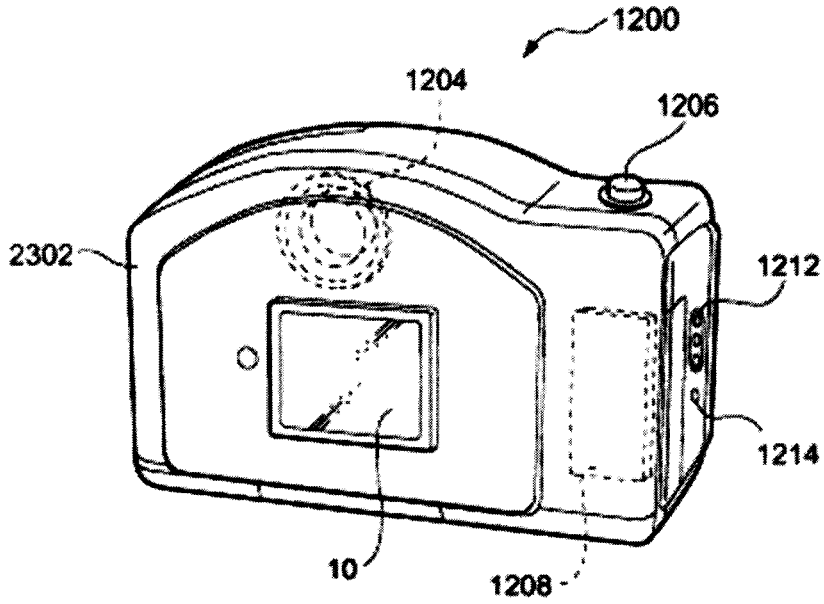
FIG. 19 is a diagram showing a digital still camera which uses the electro-optical device.

FIG. 19 is a perspective view showing a rear surface of the digital still camera. While a silver halide camera sensitizes a film by means of an optical image of a subject, the digital still camera 1200 converts the optical image of the subject into an electrical signal by an imaging element such as a CCD (Charge Coupled Device) to generate and store the imaged signal. Here, a display surface of the above-described electro-optical device is provided on the rear surface of a case 1202 in the digital still camera 1200. Since the electro-optical device 10 performs display based on the imaged signal, it functions as the finder for displaying the subject. Also, a light-receiving unit 1204 including an optical lens or the CCD is provided on a front surface of the case 1202 (a rear surface in FIG. 19).

If a photographer confirms the image of the subject displayed by the electro-optical device 10 and presses a shutter button 1206, the imaged signal of the CCD at that time is transferred to and stored in a memory of a circuit substrate 1208. In addition, in the digital still camera 1200, a video signal output terminal 1212 for performing external display and an input/output terminal 1214 for data communication are provided on a side surface of the case 1202.

Further, as the electronic apparatus, in addition to the cellular phone of FIG. 18 or the digital still camera of FIG. 19, a television, a viewfinder-type or monitor-direct-view-type video tape recorder, a car navigation device, a pager, an electronic organizer, an electronic calculator, a word processor, a workstation, a videophone, a POS (Point of Sale) terminal, an apparatus having a touch panel, and so on may be exemplified. It is needless to say that the above-mentioned electro-optical device can be applied as a display unit for various electronic apparatuses. Further, the electro-optical device is not limited to the display unit of the electronic apparatus for directly displaying the image or the character, but it can be applied as a light source of a printing apparatus to indirectly form the image or the character by irradiating light onto the subject.

What is claimed is:

1. An electro-optical device comprising a scanning line for supplying a scanning signal;

a data line for supplying a data signal, the data line intersecting the scanning line;

a pixel circuit arranged to correspond to intersection of the scanning line and the data line;

a power supply line for supplying a first voltage to the pixel circuit; and a feed line for supplying a second voltage to the pixel circuit, wherein the pixel circuit comprises:

an electro-optical element as a driven element, the electro-optical element including a first electrode and a second electrode;

a driving transistor for controlling a current flowing into the electro-optical element based on the data signal, the driving transistor being connected between the power supply line and the electro-optical element;

a first switching element provided between a gate and a drain of the driving transistor;

a capacitive element having a first end connected to the gate of the driving transistor, and a second end;

a second switching element configured to apply the second voltage as an initial voltage to the second end of the capacitive element, the second switching element being connected between the feed line and the second end of the capacitive element;

a third switching element provided between the data line and the second end of the capacitive element to be turned on in a second period after a first period, the first switching element being directly connected to the gate and the drain of the driving transistor and the first electrode of the electro-optical element being directly connected to a source of the driving transistor; and a fourth switching element being configured to block the current flowing into the electro-optical element, the fourth switching element being directly connected to the driving transistor and the first switching element, wherein the fourth switching element is turned on in a portion of the first period and is turned on in a third period after the second period.

2. The electro-optical device according to claim 1, wherein the second voltage is equal to the lowest voltage of the data signal.

3. The electro-optical device according to claim 1, wherein the first and second switching elements are transistors of a same conductivity-type, and gates of the first and second switching elements are connected to a common control line.

4. The electro-optical device according to claim 1, wherein the electro-optical element is an organic light-emitting diode element.

5. An electronic apparatus comprising the electro-optical device according to claim 1.

6. The electro-optical device according to claim 1, wherein:

the second switching element is directly connected to the feed line and the second end of the capacitive element, the third switching element is directly connected to the data line and the second end of the capacitive element, and the fourth switching element is directly connected to the power supply line.

* * * * *